US009126103B2

(12) United States Patent
Krenn et al.

(10) Patent No.: US 9,126,103 B2
(45) Date of Patent: Sep. 8, 2015

(54) CARD-HANDLING DEVICES AND SYSTEMS

(71) Applicant: Shuffle Master GmbH & Co KG., Vienna (AT)

(72) Inventors: Peter Krenn, Neufeld (AT); Ernst Blaha, Tullnerbach (AT); Attila Grauzer, Las Vegas, NV (US)

(73) Assignee: SHUFFLE MASTER GMBH & CO KG, Vienna (AT)

( * ) Notice: Subject to any disclaimer, the term of this patent is extended or adjusted under 35 U.S.C. 154(b) by 4 days.

(21) Appl. No.: 14/090,730

(22) Filed: Nov. 26, 2013

(65) Prior Publication Data

US 2014/0145399 A1 May 29, 2014

Related U.S. Application Data

(63) Continuation of application No. 13/204,988, filed on Aug. 8, 2011, now Pat. No. 8,590,896, which is a continuation-in-part of application No. 11/299,243, filed on Dec. 9, 2005, now Pat. No. Re. 42,944, which is an application for the reissue of Pat. No. 6,659,460, filed as application No. PCT/AT01/00088 on Mar. 26, 2001.

(30) Foreign Application Priority Data

Apr. 12, 2000 (AT) ..... 634/2000

(51) Int. Cl.
*A63F 1/12* (2006.01)
*A63F 1/14* (2006.01)

(52) U.S. Cl.
CPC .... *A63F 1/12* (2013.01); *A63F 1/14* (2013.01)

(58) Field of Classification Search
CPC ..... A63F 1/12
USPC ..... 273/149 R, 149 P
See application file for complete search history.

(56) References Cited

U.S. PATENT DOCUMENTS 130,281 A 8/1872 Coughlin
609,730 A 8/1898 Booth (Continued)

FOREIGN PATENT DOCUMENTS

AU 5025479 3/1980
EP 0777514 2/2000

(Continued)

OTHER PUBLICATIONS

Scarne's Encyclopedia of Games by John Scarne, 1973, "Super Contract Bridge", p. 153.

*Primary Examiner* — Benjamin Layno
(74) *Attorney, Agent, or Firm* — TraskBritt

(57) ABSTRACT

Playing card-handling devices, such as shufflers, dealing shoes, discard racks and verification systems, are rotatably secured to a gaming table to allow for functional and ergonomic adjustment of the card-handling device, without removal from the gaming table. One end of the device, preferably a front end of the device from which playing cards may be removed, has a structure that extends through an aperture in the gaming table. The device is movable within the aperture. Movement in the X-Y direction, angular movement and rotational movement, parallel to the movement of the plane of the surface of the gaming table, is enabled. The movement of the device about the aperture preferably maintains the base of the device relatively parallel to the plane of the surface of the gaming table.

20 Claims, 18 Drawing Sheets

(56) References Cited

U.S. PATENT DOCUMENTS

| | | | |
|---|---|---|---|
| 793,489 | A | 6/1905 | Williams |
| 1,014,219 | A | 1/1912 | Hall |
| 1,850,114 | A | 3/1932 | Mccaddin |
| 1,885,276 | A | 11/1932 | Mckay |
| 1,955,926 | A | 4/1934 | Matthaey |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,065,824 | A | 12/1936 | Plass |
| 2,159,958 | A | 5/1939 | Sachs |
| 2,185,474 | A | 1/1940 | Nott |
| 2,543,522 | A | 2/1951 | Cohen |
| 2,588,582 | A | 3/1952 | Sivertson |
| 2,661,215 | A | 12/1953 | Stevens |
| 2,676,020 | A | 4/1954 | Ogden |
| 2,701,720 | A | 2/1955 | Ogden |
| 2,705,638 | A | 4/1955 | Newcomb |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Howard |
| 2,755,090 | A | 7/1956 | Aldrich |
| 2,757,005 | A | 7/1956 | Nothaft |
| 2,760,779 | A | 8/1956 | Ogden et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,937,739 | A | 5/1960 | Levy |
| 2,950,005 | A | 8/1960 | Macdonald |
| 3,067,885 | A | 12/1962 | Kohler |
| 3,107,096 | A | 10/1963 | Osborn |
| 3,131,935 | A | 5/1964 | Gronneberg |
| 3,147,978 | A | 9/1964 | Sjostrand |
| 3,235,741 | A | 2/1966 | Plaisance |
| 3,305,237 | A | 2/1967 | Granius |
| 3,312,473 | A | 4/1967 | Friedman et al. |
| 3,588,116 | A | 6/1971 | Miura |
| 3,589,730 | A | 6/1971 | Slay |
| 3,595,388 | A | 7/1971 | Castaldi |
| 3,627,331 | A | 12/1971 | Erickson |
| 3,666,270 | A | 5/1972 | Mazur |
| 3,690,670 | A | 9/1972 | Cassady et al. |
| 3,716,238 | A | 2/1973 | Porter |
| 3,897,954 | A | 8/1975 | Erickson et al. |
| 3,929,339 | A | 12/1975 | Mattioli |
| 3,944,230 | A | 3/1976 | Fineman |
| 3,949,219 | A | 4/1976 | Crouse |
| 3,968,364 | A | 7/1976 | Miller |
| 4,033,590 | A | 7/1977 | Pic |
| 4,159,581 | A | 7/1979 | Lichtenberg |
| 4,162,649 | A | 7/1979 | Thornton |
| 4,232,861 | A | 11/1980 | Maul |
| 4,280,690 | A | 7/1981 | Hill |
| 4,310,160 | A | 1/1982 | Willette |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,385,827 | A | 5/1983 | Naramore |
| 4,388,994 | A | 6/1983 | Suda et al. |
| 4,397,469 | A | 8/1983 | Carter |
| 4,421,312 | A | 12/1983 | Delgado et al. |
| 4,497,488 | A | 2/1985 | Plevyak et al. |
| 4,512,580 | A | 4/1985 | Matviak |
| 4,513,969 | A | 4/1985 | Samsel |
| 4,515,367 | A | 5/1985 | Howard |
| 4,534,562 | A | 8/1985 | Cuff et al. |
| 4,566,782 | A | 1/1986 | Britt et al. |
| 4,586,712 | A | 5/1986 | Lorber et al. |
| 4,659,082 | A | 4/1987 | Greenberg |
| 4,662,637 | A | 5/1987 | Pfeiffer et al. |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,759,448 | A | 7/1988 | Kawabata |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak |
| 4,876,000 | A | 10/1989 | Mikhail |
| 4,900,009 | A | 2/1990 | Kitahara et al. |
| 4,904,830 | A | 2/1990 | Rizzuto |
| 4,948,134 | A | 8/1990 | Suttle et al. |
| 4,951,950 | A | 8/1990 | Normand et al. |
| 4,969,648 | A | 11/1990 | Hollinger et al. |
| 5,000,453 | A | 3/1991 | Stevens et al. |
| 5,067,713 | A | 11/1991 | Soules et al. |
| 5,078,405 | A | 1/1992 | Jones et al. |
| 5,102,293 | A | 4/1992 | Schneider |
| 5,121,921 | A | 6/1992 | Friedman |
| 5,154,429 | A | 10/1992 | Levasseur et al. |
| 5,199,710 | A | 4/1993 | Lamle |
| 5,240,140 | A | 8/1993 | Huen |
| 5,261,667 | A | 11/1993 | Breeding |
| 5,275,411 | A | 1/1994 | Breeding |
| 5,288,081 | A | 2/1994 | Breeding et al. |
| 5,303,921 | A | 4/1994 | Breeding |
| 5,356,145 | A | 10/1994 | Verschoor |
| 5,374,061 | A | 12/1994 | Albrecht et al. |
| 5,382,024 | A | 1/1995 | Blaha |
| 5,382,025 | A | 1/1995 | Sklansky et al. |
| 5,390,910 | A | 2/1995 | Mandel et al. |
| 5,431,399 | A | 7/1995 | Kelley et al. |
| 5,437,462 | A | 8/1995 | Breeding et al. |
| 5,445,377 | A | 8/1995 | Steinbach |
| 5,575,475 | A | 11/1996 | Steinbach |
| 5,584,483 | A | 12/1996 | Sines et al. |
| 5,586,936 | A | 12/1996 | Bennett et al. |
| 5,605,334 | A | 2/1997 | McCrea et al. |
| 5,669,816 | A | 9/1997 | Garczynski et al. |
| 5,676,372 | A | 10/1997 | Sines et al. |
| 5,681,039 | A | 10/1997 | Miller et al. |
| 5,683,085 | A | 11/1997 | Johnson et al. |
| 5,690,324 | A | 11/1997 | Otomo et al. |
| 5,692,748 | A | 12/1997 | Frisco et al. |
| 5,695,189 | A | 12/1997 | Breeding et al. |
| 5,707,287 | A | 1/1998 | McCrea et al. |
| 5,718,427 | A | 2/1998 | Cranford et al. |
| 5,722,893 | A | 3/1998 | Hill et al. |
| 5,735,525 | A | 4/1998 | McCrea et al. |
| 5,772,505 | A | 6/1998 | Garczynski et al. |
| 5,779,546 | A | 7/1998 | Meissner et al. |
| 5,803,808 | A | 9/1998 | Strisower |
| 5,941,769 | A | 8/1999 | Order |
| 5,944,310 | A | 8/1999 | Johnson et al. |
| 5,989,122 | A | 11/1999 | Roblejo et al. |
| 6,019,368 | A | 2/2000 | Sines et al. |
| 6,039,650 | A | 3/2000 | Hill et al. |
| 6,068,258 | A | 5/2000 | Breeding et al. |
| 6,093,103 | A | 7/2000 | McCrea et al. |
| 6,117,012 | A | 9/2000 | McCrea et al. |
| 6,126,166 | A | 10/2000 | Lorson et al. |
| 6,139,014 | A | 10/2000 | Breeding et al. |
| 6,149,154 | A | 11/2000 | Grauzer et al. |
| 6,165,069 | A | 12/2000 | Sines et al. |
| 6,165,072 | A | 12/2000 | Davis et al. |
| 6,217,447 | B1 | 4/2001 | Lofink et al. |
| 6,250,632 | B1 | 6/2001 | Albrecht |
| 6,254,096 | B1 | 7/2001 | Grauzer et al. |
| 6,254,484 | B1 | 7/2001 | McCrea, Jr. |
| 6,267,248 | B1 | 7/2001 | Johnson et al. |
| 6,270,404 | B2 | 8/2001 | Sines et al. |
| 6,299,534 | B1 | 10/2001 | Breeding et al. |
| 6,299,536 | B1 | 10/2001 | Hill |
| 6,325,373 | B1 | 12/2001 | Breeding et al. |
| 6,346,044 | B1 | 2/2002 | McCrea, Jr. |

(56) References Cited

U.S. PATENT DOCUMENTS

| | | | |
|---|---|---|---|
| 6,361,044 | B1 | 3/2002 | Block et al. |
| 6,402,142 | B1 | 6/2002 | Warren et al. |
| 6,403,908 | B2 | 6/2002 | Stardust et al. |
| 6,454,266 | B1 | 9/2002 | Breeding et al. |
| 6,460,848 | B1 | 10/2002 | Soltys et al. |
| 6,517,435 | B2 | 2/2003 | Soltys et al. |
| 6,517,436 | B2 | 2/2003 | Soltys et al. |
| 6,520,857 | B2 | 2/2003 | Soltys et al. |
| 6,527,271 | B2 | 3/2003 | Soltys et al. |
| 6,530,836 | B2 | 3/2003 | Soltys et al. |
| 6,530,837 | B2 | 3/2003 | Soltys et al. |
| 6,533,276 | B2 | 3/2003 | Soltys et al. |
| 6,533,662 | B2 | 3/2003 | Soltys et al. |
| 6,568,678 | B2 | 5/2003 | Breeding et al. |
| 6,579,180 | B2 | 6/2003 | Soltys et al. |
| 6,579,181 | B2 | 6/2003 | Soltys et al. |
| 6,582,301 | B2 | 6/2003 | Hill |
| 6,588,750 | B1 | 7/2003 | Grauzer et al. |
| 6,588,751 | B1 | 7/2003 | Grauzer et al. |
| 6,629,889 | B2 | 10/2003 | Mothwurf |
| 6,629,894 | B1 | 10/2003 | Purton |
| 6,637,622 | B1 | 10/2003 | Robinson |
| 6,651,981 | B2 | 11/2003 | Grauzer et al. |
| 6,651,982 | B2 | 11/2003 | Grauzer et al. |
| 6,651,985 | B2 | 11/2003 | Sines et al. |
| 6,655,684 | B2 | 12/2003 | Grauzer et al. |
| 6,659,460 | B2 | 12/2003 | Blaha et al. |
| 6,663,490 | B2 | 12/2003 | Soltys et al. |
| 6,676,127 | B2 | 1/2004 | Johnson et al. |
| 6,688,979 | B2 | 2/2004 | Soltys et al. |
| 6,698,756 | B1 | 3/2004 | Baker et al. |
| 6,712,696 | B2 | 3/2004 | Soltys et al. |
| 6,719,288 | B2 | 4/2004 | Hessing et al. |
| 6,722,974 | B2 | 4/2004 | Sines et al. |
| 6,726,205 | B1 | 4/2004 | Purton |
| 6,758,751 | B2 | 7/2004 | Soltys et al. |
| 6,886,829 | B2 | 5/2005 | Hessing et al. |
| 6,889,979 | B2 | 5/2005 | Blaha |
| 6,905,121 | B1 | 6/2005 | Timpano |
| 7,036,818 | B2 | 5/2006 | Grauzer et al. |
| 7,059,602 | B2 | 6/2006 | Grauzer et al. |
| 7,073,791 | B2 | 7/2006 | Grauzer et al. |
| 7,114,718 | B2 | 10/2006 | Grauzer et al. |
| 7,137,627 | B2 | 11/2006 | Grauzer et al. |
| 7,213,812 | B2 | 5/2007 | Schubert et al. |
| 7,234,698 | B2 | 6/2007 | Grauzer et al. |
| 7,255,344 | B2 | 8/2007 | Grauzer et al. |
| 7,261,294 | B2 | 8/2007 | Grauzer et al. |
| 7,264,241 | B2 | 9/2007 | Schubert et al. |
| 7,278,923 | B2 | 10/2007 | Grauzer et al. |
| 7,322,576 | B2 | 1/2008 | Grauzer et al. |
| 7,338,044 | B2 | 3/2008 | Grauzer et al. |
| 7,367,561 | B2 | 5/2008 | Blaha et al. |
| 7,374,170 | B2 | 5/2008 | Grauzer et al. |
| 7,384,044 | B2 | 6/2008 | Grauzer et al. |
| 7,407,438 | B2 | 8/2008 | Schubert et al. |
| 7,413,191 | B2 | 8/2008 | Grauzer et al. |
| 7,753,798 | B2 | 7/2010 | Soltys et al. |
| 7,933,448 | B2 | 4/2011 | Downs, III |
| 7,946,586 | B2 | 5/2011 | Krenn et al. |
| 2002/0063389 | A1 | 5/2002 | Breeding et al. |
| 2002/0163125 | A1 | 11/2002 | Grauzer et al. |
| 2003/0047870 | A1 | 3/2003 | Blaha et al. |
| 2003/0071413 | A1 | 4/2003 | Blaha |
| 2003/0073498 | A1 | 4/2003 | Grauzer et al. |
| 2005/0040594 | A1 | 2/2005 | Krenn et al. |
| 2007/0045959 | A1 | 3/2007 | Soltys |
| 2007/0057469 | A1 | 3/2007 | Grauzer et al. |
| 2007/0222147 | A1 | 9/2007 | Blaha |
| 2008/0006997 | A1 | 1/2008 | Scheper et al. |
| 2008/0006998 | A1 | 1/2008 | Grauzer et al. |
| 2010/0038849 | A1 | 2/2010 | Scheper et al. |

FOREIGN PATENT DOCUMENTS

| | | |
|---|---|---|
| WO | 87/00764 | 2/1987 |
| WO | 98/14249 | 4/1998 |
| WO | 98/40136 | 9/1998 |
| WO | 99/52611 | 10/1999 |
| WO | 00/51076 | 8/2000 |
| WO | 2006/031472 | 3/2006 |

Fig. 5A
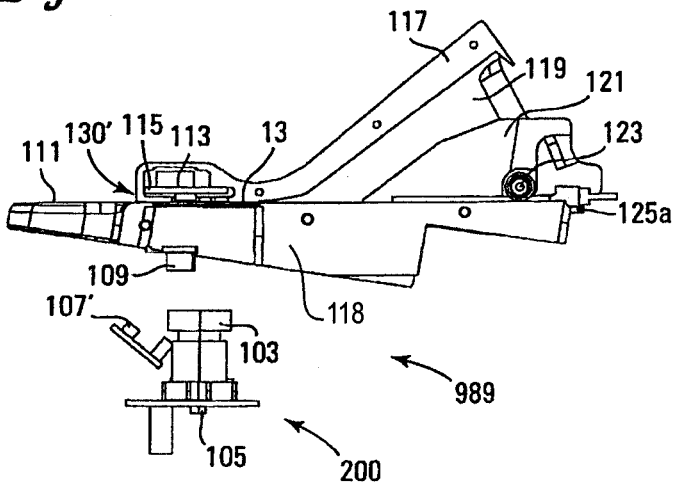
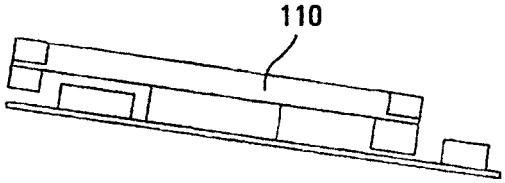
Fig. 5B

CARD-HANDLING DEVICES AND SYSTEMS

CROSS-REFERENCE TO RELATED APPLICATIONS

This application is a continuation application of U.S. patent application Ser. No. 13/204,988 filed Aug. 8, 2011, now U.S. Pat. No. 8,590,896, issued Nov. 26, 2013, which, in turn, is a continuation-in-part of U.S. patent application Ser. No. 11/299,243, filed Dec. 9, 2005, now U.S. Pat. No. RE42, 944, issued Nov. 22, 2011, which is a reissue of U.S. patent application Ser. No. 10/009,411, filed Dec. 10, 2001, now U.S. Pat. No. 6,659,460, issued Dec. 9, 2003, which is a national phase entry under 35 U.S.C. §371 of International Patent Application PCT/AT01/00088, filed Mar. 26, 2001, which, in turn, claims priority from Austrian Application Serial No. 634/2000, filed Apr. 12, 2000, now Austrian Patent 409 222, the disclosures of each of which are hereby incorporated by reference in their entireties.

TECHNICAL FIELD

The present technology relates to the field of playing card-handling devices such as shufflers (both batch and continuous), delivery shoes, card discard trays and the like. These card-handling devices may have card reading or imaging capability and may be in communication links with other intelligent components in a casino environment.

BACKGROUND

In the gaming industry, especially in casino table gaming, there has been a significant move toward more automation. Playing cards are read, wagers are electronically read, player identifications are read, and the totality of the information is communicated to one or more processors, servers or computers to store and/or analyze the information for gaming and record keeping functions.

As with many technological improvements, there are often sacrifices by workers, often in the sense that functionally improved environments may not be as ergonomically satisfactory as more traditional modes of operation. The environment of playing card delivery and removal is one particular area of dissatisfaction amongst dealers in the casino table card game environment.

Originally, dealers would take one or more decks of playing cards, shuffle them manually, and deliver cards out of their hands. Dealers were able to move, bend, twist, shift forward and backwards, lift their aims and had a great degree of freedom of movement. Even though the work was repetitive, this freedom of movement relieved some of the physical stress that can build up when working long hours in a single position, with repetitive movements. Even with the initial advent of delivery shoes in the 1950s, the dealers were still able to move while they were manually shuffling cards. The delivery shoes were small and light and moved easily over the gaming surface.

With the successful penetration of the casino market with automatic shufflers, primarily by Shuffle Master, Inc., the dealers are no longer required to perform repetitive shuffling tasks, but they have less freedom of movement during work. The shuffler is typically mounted in a fixed position on a table, positioned so that the structure does not interfere with play and in a position that is intended to be comfortable for a dealer of average size. The dealer inserts cards in a single stationary location, the playing cards are shuffled, the dealer removes the playing cards from a stationary card delivery tray or chute, and the dealer deals out the cards to each player position, himself and or a community position.

Shufflers, in particular, can vary significantly in height, width, depth and function on a table. Different functions include batch shufflers (which randomize a complete set of cards, which are then removed from the shuffler as a group, or in multiple subgroups) and continuous shufflers (a number of cards always remain in a shuffler, smaller subsets are removed periodically, and spent cards are reintroduced into the shuffler and randomized into the number of cards that remain in the shuffler). Some shufflers are mounted flush with a gaming table surface, while others are fixed to a platform adjacent the table or mounted with brackets to a side of the table adjacent the dealer's position. Yet others sit on the table surface. Each of these positions requires the dealer to make repetitive moves to a single stationary position where the shuffler remains stationary. As dealers are of different heights, arm-lengths and flexibility, there is no perfect single position at which a playing card system, such as a shuffler, may be fixed.

As mentioned above, some shufflers such as the ONE2SIX® shuffler, as described in U.S. Pat. No. 6,659,460 rest on the gaming table surface. Although the ONE2SIX® shuffler is capable of being repositioned on the table surface, its elevation with respect to the gaming surface is high as compared to more low profile shufflers.

Examples of continuous and batch shufflers that are known in the art and may be used in the practice of the present invention include, by way of non-limiting examples, those shown in U.S. Pat. Nos. 7,384,044; 7,322,576; 7,261,294; 7,255,344; 7,234,698; 7,137,627; 7,059,602; 7,036,818; 6,905,121; 6,886,829; 6,719,288; 6,651,981; 6,588,751; 6,588,750; 6,568,678; 6,254,096; 6,149,154 and the like. Each of these patents is incorporated herein by reference, in their entirety. Some of these shuffling devices also have built-in card-reading capability.

Similarly, any delivery shoe or discard rack may be used on a gaming table, such as those disclosed, by way of non-limiting examples, in U.S. Pat. Nos. 7,407,438; 7,374,170; 7,278,923; 7,264,241; 7,213,812; 7,114,718; 6,637,622; 6,402,142; 6,299,536; 6,039,650; 5,722,893; and the like, each of which is incorporated herein by reference.

BRIEF SUMMARY

Playing card delivery devices such as card shufflers, card shoes and discard racks comprise a housing and a support base. The support base is supported by a gaming table surface.

The housing includes an area that stores multiple playing cards, and an opening in the housing through which playing cards may be removed.

A structure extends below the support base, positionable in an aperture in a gaming table. The support base is movable on the gaming table surface. Movement is limited by an area defined by the size and shape of the aperture in the table.

The present invention may be characterized as a playing card delivery system. The system includes a gaming table having a top play surface with an aperture extending therethrough. A playing card delivery device with a playing card delivery shoe is elevated with respect to an elevation of a playing card reader located in the playing card delivery device. The playing card reader is insertable in the aperture. The device is mounted so that the playing card reader is located below the game table top play surface and the playing card delivery shoe is located above the top play surface.

The present invention is a modular card-handling device. The device includes a base, a shoe that is fixedly mounted to the base, and a card-holding device comprising a card infeed area and a card output area. The shoe has a quick-release locking mechanism that connects the shoe to the card output area of the card-handling device.

The present invention may also be characterized as a card-handling system having an area for holding cards, a card input area and a card output area. The card output area is configured for manual removal of one card at a time. The card output area has an opening for removal of cards that is offset from a center of the card output area.

BRIEF DESCRIPTION OF THE DRAWINGS

FIGS. 5*a* and 5*b* are detailed side cut away views of the card-reading shoe's sensors, camera system, and processing components with support structures removed.

DETAILED DESCRIPTION

Figure 1:
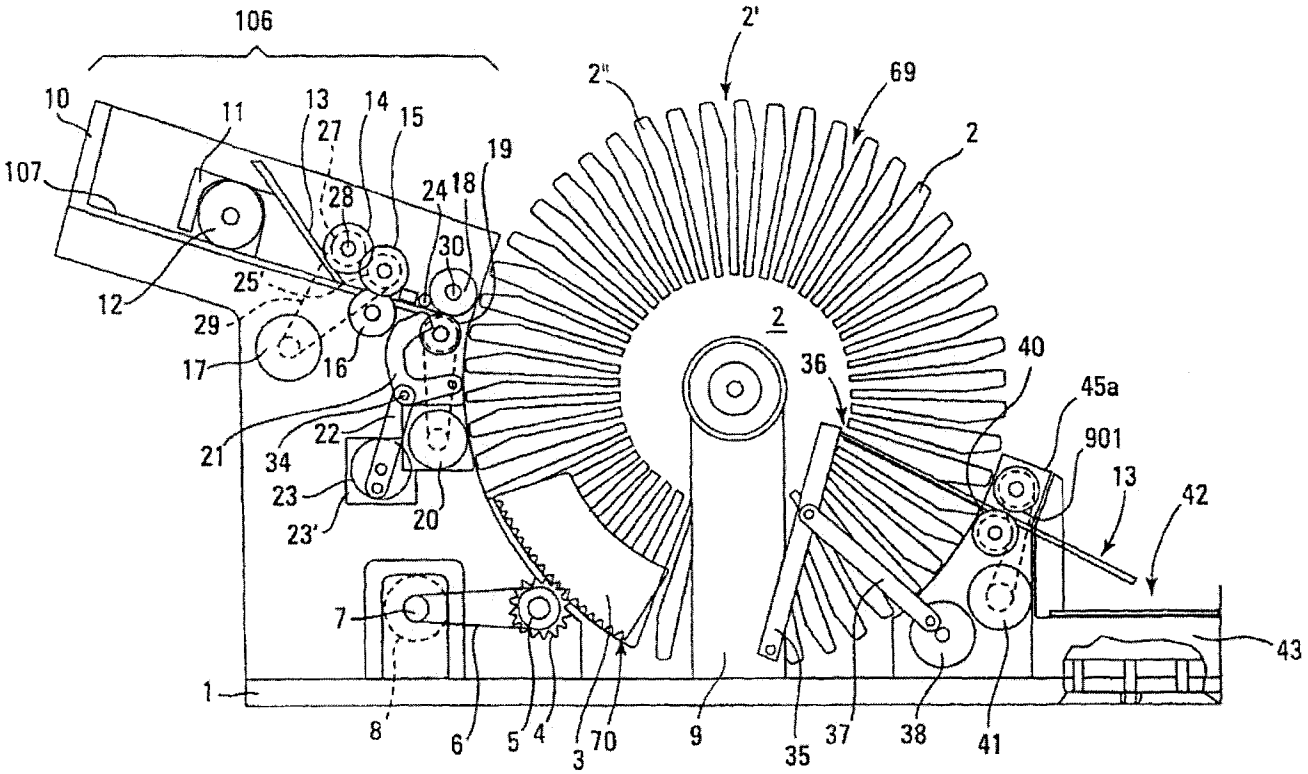
FIG. 1 is a side elevational view of a playing card shuffler (with cover removed) with a removable delivery end that is one example of a playing card-handling device of the present invention.

Playing card-handling devices, such as shufflers, dealing shoes, discard racks and verification systems are movably mounted to a gaming table to allow for functional and ergonomic adjustment of the card-handling device. Structures of the present invention provide card-reading capability without increasing the height of the device on the table. The playing card-handling device is attached to the gaming table in a manner that allows, the dealer to rotate, swivel or move the device linearly in a defined area on the table. A relatively flat base beneath the playing card-handling device remains relatively parallel to the flat surface of a gaming table and rests on the gaming table surface as the card-handling device is repositioned. The device is able to slide and pivot in directions parallel to the surface of the gaming table. At the same time, range of movement is restricted to fix the device with a predetermined surface area of the gaming table. Major movement no greater than 30 cm, for example, is restricted in any single direction along the surface of the gaming table.

Near one end of the device is the area of the device that is attached to or positioned to extend through an aperture in the table. The area of attachment is preferably a front end of the device from which playing cards may be removed as individual cards, subsets of cards (e.g., hands of cards during a round of play of a game), and complete sets of cards (e.g., a deck of cards or multiple decks of cards, or all playing cards remaining after exhaustion of a predefined amount of play of the game).

For purposes of this disclosure the term "attachment" means connected with physical means or the movement restricted by a combination of the weight of the device and the size of the aperture from which a portion of the device extends therethrough. In the second instance, the weight of the device prevents detachment of the device from the table.

If the card-handling device is a discard rack, the pivot point is located near the area that receives spent cards. If the device is a shoe, the point of attachment is preferably the card delivery end of the shoe. It is preferable that the point of attachment be proximate the card-imaging system when an imaging system is part of a modular addition to an existing structure. This arrangement minimizes the height of the card-handling device.

At least rotation of the device within a defined area of the gaming table (i.e., an aperture) is required, and some X-Y components of movement parallel with the plane of the surface of the gaming table is optionally allowed. The rotation of the device within a defined area preferably maintains the base of the device relatively parallel to the plane of the surface of the gaming table, but some rotation or elevation of the rear of the device off of the surface of the gaming table may also be allowed or not. The rotation capability does not have to be 360 degrees, but may be limited as designed to less than 360 degrees, including 180, 145, 120, 100, 90 or 45 degrees. A rotation of at least 10 degrees up to those limits is desired. In one form of the invention, the card-handling device is a shuffler and the shuffles is positionable on a base that is supported by the gaming table surface.

The precise mechanism for attachment of the device may be varied, as the design requires, as long as the swiveling function is present. It is preferred that the card-handling system of the present invention includes a camera reading system built into the device. In one example, the card-reading system is positioned at least in part below the gaming table surface, especially at a position below an area of the device over which playing cards are moved and especially removed from the device (such as the front delivery tray or shoe in the device). Non-limiting examples of mechanisms that may be used for attachment of the card-handling device (with or without a separate base) to the gaming table include a male fixture (spindle, rod, bolt, post, pin or the like, and one or multiple posts may be used) on the device and a female receptor (hole, threaded hole, opening, or the like) on the gaming table surface. The male and female elements may be reversed with respect to the device and the table. Snap attachments (receptors and inserts), clips and inserts, slide engaging elements, opposed plates with locking elements, recesses and plates, and other known locking or locking and release systems may be alternatively used.

The attachment may or may not be the component that itself enables rotation (e.g., a post in a hole receptor), and is preferably a fixture carried on the table (in whole or in part) or carried on the card-handling device such as a shuffler (in whole or in part). Among the preferred constructions is the use of a platform or base set slightly above, flush with or slightly recessed into the surface of the gaming table or a platform attached to the gaming table or a platform adjacent to the gaming table. By having a separate platform or panel, initial installation, replacement, repair and upgrading of the attachment system may be easily effected. The panel may be built into the table and carry one half of the attachment subcomponent or the device itself may carry the platform or panel with it so that the panel on the device can be attached to receptors on the table. The panels, whether built into the table or the device, may have male or female subcomponents built therein. If both the device component and the table component have female receptors, a separate male-male connector may be used.

In one preferred form of the invention, the mode of attachment is a substantially circular support plate that lies over an aperture of a smaller diameter. A portion of the device, preferably the card-imaging system is mounted to the support plate. The device is movable within the aperture. Preferably, the diameter of the aperture is much larger than a diameter of an outer circumference of the card-imaging system protective cover, allowing for a range of movement within the aperture.

The system, devices and components of the present technology may be generally described as follows. A playing card-handling device that can be associated with a casino table has a housing with a support base. There is an area within the housing that can store multiple playing cards, such as sets of cards, a single deck of playing cards or multiple decks of playing cards. There is an opening in the housing through which playing cards may be removed. The base of the playing card delivery device has a connector attached to the base. The device is movable within the connector. The support base moves within a single plane, while the support base is supported by a gaming table or platform placed adjacent to or is attached to a gaming table. The preferred embodiment is to have the playing card delivery device movably mounted (pivotally and/or for linear movement) to a gaming table, but a platform may be attached to an edge of the gaming table, or a platform moved to a position adjacent the gaming table, with the playing card delivery device instead supported by the platform.

The support base is preferably in contact with a top surface on the gaming table, the single plane comprising the top surface of the gaming table. In one embodiment, the connector may be a panel that is attached to the gaming table and rotates in a plane parallel to the surface of the gaming table. In another alternative, the panel is attached to the gaming table and is seated at a level above, flush with or below the top surface of the gaming table. In other embodiments, the panel is attached to the card-handling device. The device is preferably a playing card shuffler and alternatively is a delivery shoe, a discard rack or a deck verification device. Both batch shufflers and continuous shufflers may be used. The shuffler preferably has a playing card reader that sends signals indicative of at least rank (and also suit and other special markings) of a playing card, the reader located below the support base to minimize a height of the device above the surface of the gaming table. The placement of the playing card reader below the surface of the gaming table and provision of the rotating and linear movement functions reduces the overall height of the shuffler above the gaming table surface and improves ergonomics by both the reduced height and the movable positioning capability. The playing card reader preferably is fixed at an angle between about 70 and 89 degrees or between about 70 and 85 degrees with respect to the plane of the gaming table top surface. This provides a wider angle of vision when reading the playing cards and improves reading accuracy. The playing card reader moves with the shuffler as the shuffler moves about the top surface of the gaming table.

The present invention may be characterized as a playing card delivery system. The system includes a gaming table having a top play surface with an aperture extending therethrough. The system also includes a playing card delivery device having a playing card delivery shoe elevated with respect to a playing card reader located in the playing card delivery device. The playing card reader is insertable into the aperture of the gaming table. The playing card delivery device is mounted so that the playing card reader is located below the game table top play surface and the playing card delivery shoe is located above the top play surface.

One example of a playing card delivery device, contemplated by the present invention, includes a playing card shuffler with the playing card reader built into a front, playing card delivery end. The playing card delivery device is movable about the front end of the device while the playing card reader remains below the top play surface.

In another example of the invention, the playing card delivery device comprises a playing card delivery shoe, with the playing card reader built into a front delivery end of the shoe. The shoe is movable about the front end of the device while the playing card reader remains below the top play surface.

In one preferred form of the invention, a swivel plate is attached to a front end of the card delivery device, and the swivel plate rotates in a plane parallel to the top play surface. When the card delivery device is a shoe, the playing card reader and the playing card shoe are fixedly attached such that the combined device defines a removable module.

Regardless of the type of playing card-handling device, according to the invention, the movement of the playing card delivery device on a gaming table is limited by the geometry of the gaming table aperture and the geometry of a structure housing the playing card reader. Preferably, the playing card delivery device is movable in a plane parallel to the gaming surface and in at least one of the following directions: rotational, arc-shaped, straight line and an irregular path.

The present invention may also be defined as a modular card-handling device. The device in its broadest sense includes a base, a shoe that is fixedly mounted to the base and a card-holding device. The card-holding device includes a card infeed area and a card output area. According to the invention, the shoe has a quick-release locking mechanism that connects the shoe to the card output area of the card-handling device.

In one example of the invention, the card-handling device has a card-imaging system. The card-handling device may also include a card-shuffling mechanism or removable cartridge. The card-imaging system may be affixed to the card output area of the card-holding device, wherein the card output area is removable from the card-shuffling mechanism. In one example of the invention, a processor board is mounted in the base. The processor communicates with the card-imaging system. In an example of the invention, the card output area is fixedly mounted to the base.

According to the invention, a card-handling system is provided, comprising an area for holding cards to be used in a card game, a card input area, a card output area, the card output area capable of providing one card at a time for manual delivery to a card game, wherein the card output area has an opening for removal of cards that is offset from a center of the card output area. In an example of the invention, the card-handling system further comprises a card-imaging system, wherein the card output area has an upper plate, wherein the upper plate is larger on a first side than on a second side, wherein the card-imaging system is positioned beneath the larger side. A light source may be located beneath the larger side. The card-handling system may be a shoe, a shuffler or a discard rack.

A review of the figures will further enhance an appreciation of the scope of the present technology. FIG. 1 shows a left-side perspective view of a non-limiting example of one embodiment of a modular shuffler design that can be used in association with the technology described herein. This shuffler is described in detail in U.S. Pat. No. 6,659,460 (the disclosure incorporated by reference above). This patent is owned by a subsidiary of Shuffle Master, Inc. of Las Vegas, Nev. This shuffler is shown with a removable hand-forming front end 43, but the shuffling mechanism may be used in connection with the technology of the present invention.

A shuffling storage means 2' or carousel is situated on a console formed of two legs 9, which is arranged on a base plate 1. Shuffling means is accomplished by a rotatably held drum or carousel 2. The drum 2 is connected via spacers (not shown) with two disks 3. The flanges 2" of the drum 2 are provided with multiple compartment-like slots 69 which are provided for receiving playing cards 13. Preferably, each compartment is capable of holding one or more cards.

The disks 3 are each provided with a circular toothing 70. The shuffling storage means 2' can be driven via a pinion 4 and a toothed pulley 5, which is rigidly connected with the same, with pinion 4 and toothed pulley 5 both being jointly held rotatably in place by bars or side supports (not shown), and a toothed belt 6 via a second toothed pulley 7 and a motor 8, as shown in phantom. The motor 8 is driven via a random-check generator and optionally moves the shuffling storage means 2' in mutually opposite directions, so that an oscillating movement of the shuffling storage means 2' can occur.

A storage container 10 (card input area) for the played cards 13 is provided, which is part of an input apparatus assembly 106. The input apparatus assembly 106 comprises a wedge 11 that rolls by way of a support roller 12, which is arranged rotatably in the same on an inclined floor 107 of the storage container 10 against two elastic rollers 14. The two rollers 14 are held rotatably on a common shaft 28 in the side walls (not shown) of the storage container 10 and can be driven jointly with the rollers 15 via pulley 29 (optionally a toothed belt not shown), as well as a pulley 27 via a motor 17. Two rollers 16 touch the two rollers 15 at a circumference, so that they are co-rotated by surface friction.

Two bridges each form with the floor 107 of the storage container 10 a gap-like draw-in zone 25', which is substantially the thickness of one playing card 13 to guarantee that only one card at a time is conveyed to the shuffling storage means 2'. A sensor 24 is provided as a preferably optical sensor for recognizing the respectively moved playing card 13. Every playing card 13, which is moved from the storage container 10 to the shuffling storage means 2', must therefore at first pass the gap-like draw-in zone 25' one after the other and then the sensor 24, with the sensor 24 being covered or triggered at first by the playing card 13 entering a sensor zone and being uncovered again after the passage of the playing card 13. An electronic control, preferably a microprocessor, which is provided downstream of the sensor 24, therefore registers the change from covered to uncovered as the playing card 13 passes, as long as the electronic control does not recognize a jam in the card path.

The electronic control adds the playing cards 13 inserted one by one into the randomly selected individual compartments 69 of the shuffling storage means 2' to an electronic register and subtracts the playing cards 13 taken from individual compartments 69 according to their number from the electronic register with the goal of keeping a continual inventory of the playing cards 13 situated in the card-handling device. In one example of the invention, a random group of playing cards 13 is formed in each compartment 69.

A jam in the card path is recognized when the rollers 14, 15 or 19 are blocked and thus the motors 17 and 20 show an increased power consumption. Alternatively, a jam can be recognized when the playing card 13 covers the sensor 24 for a longer period than corresponds to the conveying speed of rollers 14 and 15 (and opposing roller 16) with respect to the conveyance of a playing card 13 or when the sensor 24 remains uncovered for a longer period although the electronic control triggers the drive of the rollers 14 and 15 and the playing cards 13 are located in the storage container 10, which fact can also be verified through a sensor (not shown) in floor 107.

The roller pair 19 and the pair of rollers 18, which touches the other pair on the circumference and which are each situated on a shaft 30, can be driven in the same manner by motor 23' as described above.

The two levers 21 are used for fully pushing the respectively moved playing card 13 into a compartment 69 of the shuffling storage means 2' and can be driven in an oscillating fashion via a rod 22, which is swivelably connected with one of the levers 21 by a shaft 34, through an eccentric disk 23 seated on the motor 23'.

The output of the playing cards 13 from the compartments 69 to a modular, hand-forming card storage means 42, occurs by means of two swiveling aims 35, which are swivelably held in the two legs 9 and are oscillatingly drivable via lever 37 and via an eccentric disk 38 seated on a motor. The two swiveling arms 35 each carry at their upper end an inwardly projecting rail 36, which grasps the playing cards 13 situated in a compartment 69 and conveys them to a nip line of two clamping rollers 40. The clamping rollers 40 are held in plate bars and are simultaneously drivable by a motor 41.

The clamping rollers (or nip rollers) 40 convey the respectively moved group of playing cards 13 to the card storage means 42, as shown in FIG. 1, for the shuffled cards for the purpose of a stack-wise removal of the group of playing cards 13, or to an alternate modular card storage means, described below (not shown) for a removal of shuffled playing cards 13 one at a time.

When playing cards 13 are removed from the compartments 69 of the shuffling storage means 2', this occurs via the withdrawing apparatus 35, 37, 38, as described above. In the present embodiment, a compartment 69 can only be emptied completely. Since the electronic control system is informed at all times about the number of playing cards 13 per compartment (=card value) it is thus easy to determine how many cards are taken from the shuffling storage means 2' and placed into a modular card output end.

A sensor detects actuation of the withdrawing apparatus 35, 37 that eject all cards from a compartment 69 as a group so that they are further carried by rollers 40 (in housing 45*a*) through nip 901 in the housing 45*a* and ejected into a delivery shoe as described below. Motor 41 drives nip rollers 40.

The sum total of the playing cards 13 situated in the shuffling storage means 2' is thus obtained in a simple manner by the addition of the playing cards 13 inserted in the shuffling storage means 2' and the subtraction of the playing cards 13 removed therefrom.

It is understood that the method can also be applied to a card shuffler which allows the removal of individual playing cards 13 from the shuffling storage means 2', i.e., an entire compartment 69 is therefore not completely emptied. In this case it is not necessary that the electronic control system stores the number of playing cards 13 per compartment 69, because after the removal of the individual playing cards 13 from the shuffling storage means 2' the same can be moved past a sensor again. As a result, the electronic control system is informed at all times about the playing cards 13 individually supplied to and removed from the shuffling storage means 2', as a result of which the sum total of the playing cards 13 situated in the shuffling storage means 2' is always known. This shuffler with the tray 43 module removed is one preferred card-shuffling component of the present invention. These and other features of this non-limiting example of a shuffler may be found in U.S. Pat. No. 6,889,979, which is incorporated by reference herein in its entirety.

Figure 2:
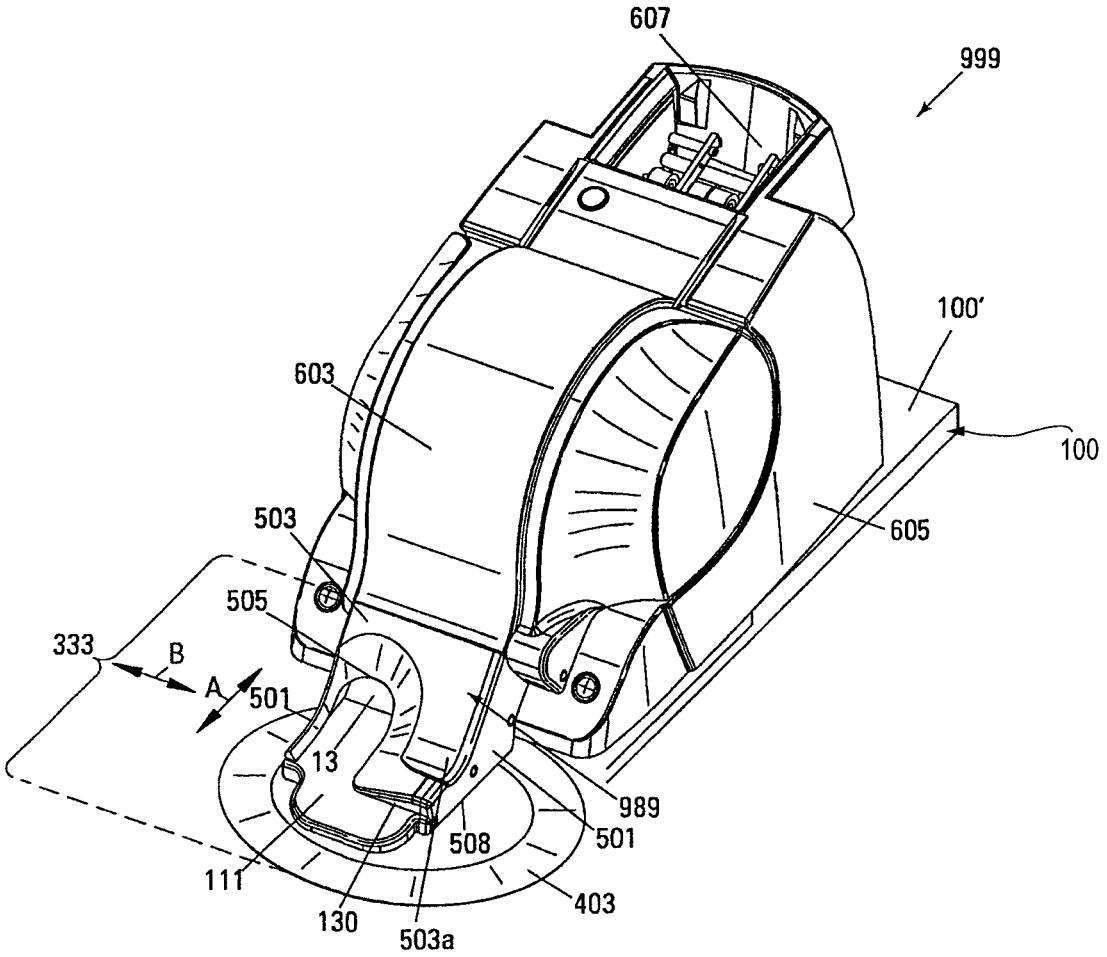
FIG. 2 is a perspective view of an exemplary playing card-shuffling device fixed to a movable base.

FIG. 2 is a perspective view of a card delivery device of the present invention. The device includes a shuffler 999 that is positioned on a base 100. The base 100 includes a substantially flat portion 100' that is positioned beneath the shuffler 999, a substantially flat, circular swivel plate 403 and a delivery shoe assembly 989, both affixed to the flat portion 100'. A playing card insertion area 607 is shown on the shuffling device 999. A housing encloses the mechanism shown in FIG. 1 for shuffling playing cards. Section 333 defines a playing card delivery zone comprising a delivery shoe assembly 989. The shoe assembly 989 in this embodiment is affixed to the flat portion 100' but is removably attached to the shuffler 999, as is described in more detail below. In other embodiments, the shoe assembly 989 is removably attached to the flat portion 100'. In yet other embodiments, the delivery shoe assembly 989 is removably attached to the shuffler 999, and the swivel plate 403 is attached to the delivery shoe assembly 989, and there is no separate base. Delivery shoe assembly 989 has a front cover plate 503 with a beveled finger insertion slot 505 that exposes a playing card 13 for withdrawal. Section 503*a* and side wall 501 are additional portions of the front cover plate 503. A flat draw plate 111 provides a surface across which playing card 13 is drawn and read by a playing card-imaging system 200 (shown in FIG. 3) located under the draw plate 111. Extension plate 130 stabilizes the playing cards 13 as they are individually withdrawn. The swivel plate 403 in one embodiment is securely fastened to a base 508 of the delivery shoe assembly 989 by an attachment system. As pressure is applied by a dealer against the left side 605 (or the right side, not shown) of the shuffler 999, the shuffler 999 pivots by forcing the swivel plate or cover plate 403 to rotate with respect to its connection point to the table about axis 901' (shown in FIG. 3). The entire plate 403 may also have more limited motion forward and backwards, for example, in directions A and B with respect to the plate 403 by slides, glides pins in elongated holes and the like (not shown). When plate 403 is a swivel plate, it actually moves with the rotation of the card delivery device. In other embodiments, plate 403 is a cover plate, that is fixed on the table, does not rotate, and the connector between the card delivery device and the cover plate 403 allows relative rotation of the card delivery device. In one embodiment, the swivel plate 403 is fixed with respect to the shuffler 999 and pivots and otherwise moves in the plane of the gaming surface, but is not mechanically attached to the table.

In alternative embodiments (not shown) the card-handling device is a shoe and the shuffler 999 is replaced with a card-holding cartridge that feeds cards into the delivery shoe assembly 989. Suitable cartridges are fully disclosed in application Ser. No. 12/228,713, filed Aug. 15, 2008, titled Intelligent Automatic Shoe and Cartridge, and assigned to Shuffle Master, Inc. The content of this application is incorporated by reference in its entirety.

Figure 3:
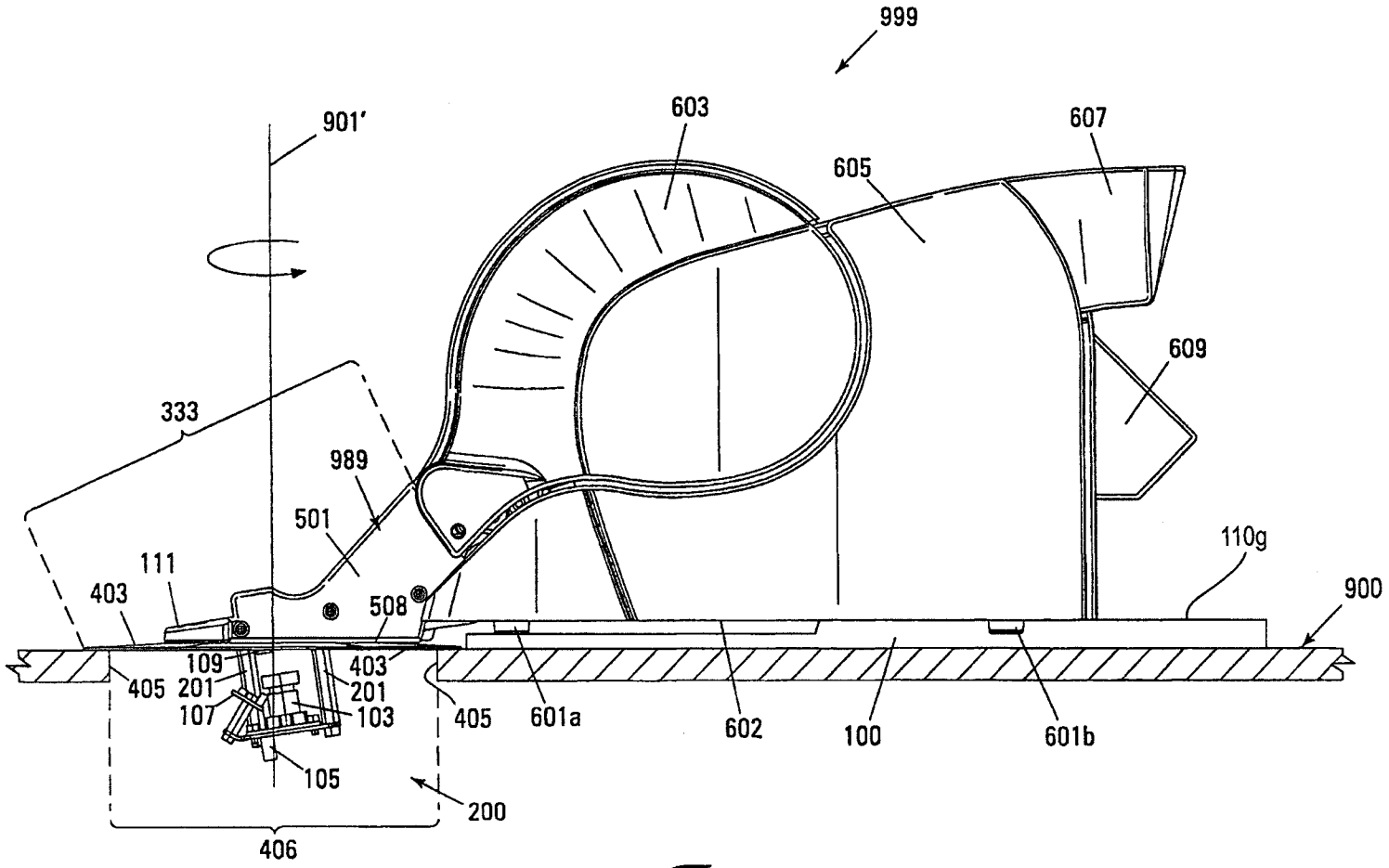
FIG. 3 is a left-side elevational view of a playing card shuffler mounted on a movable base that is supported by a gaming table surface.
Figure 12:
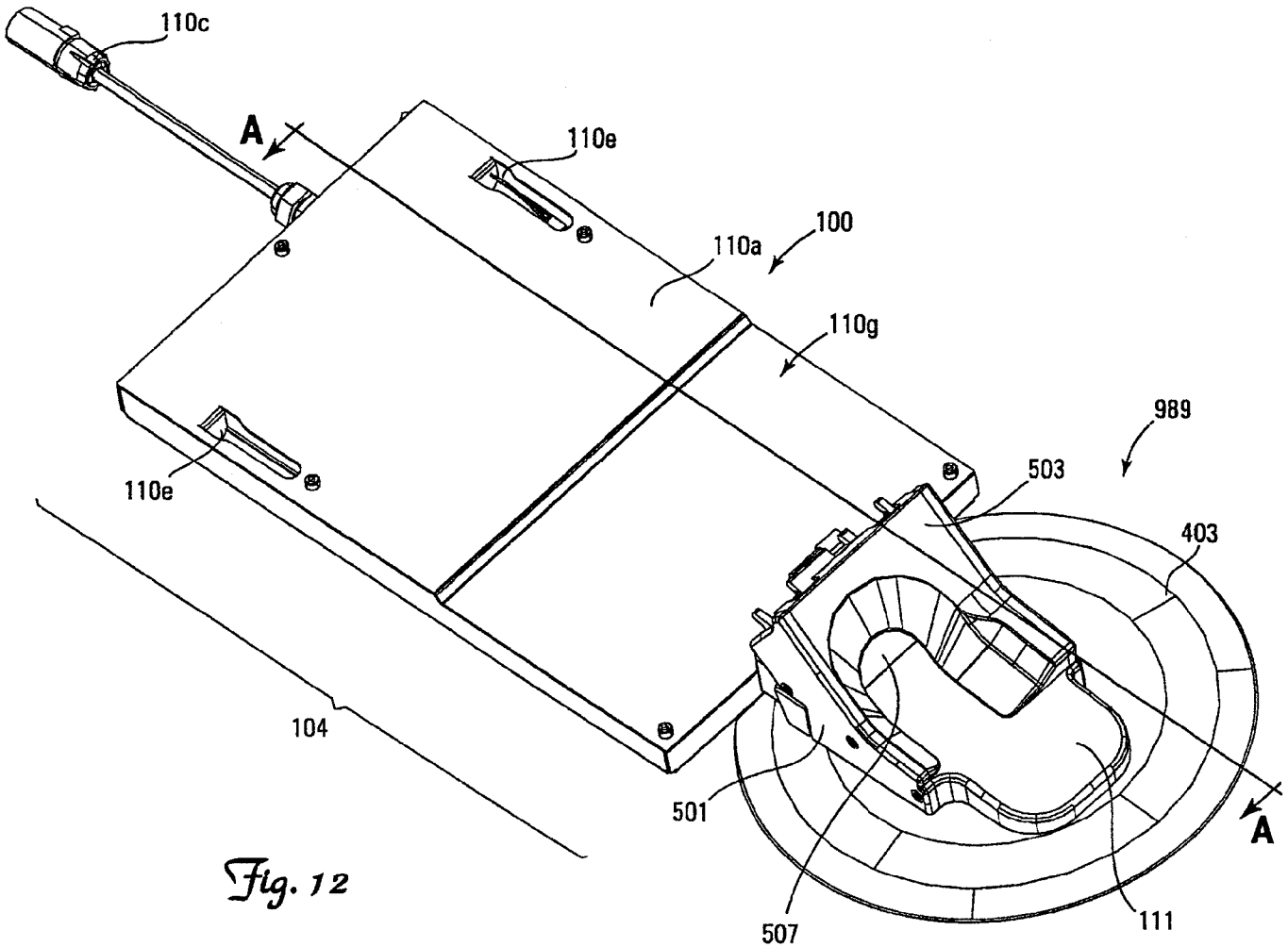
FIG. 12 is a top perspective view of the card-reading shoe assembly attached to a base.

FIG. 3 is a left-side elevational view of a playing card shuffler 999 (including base plate 100) with a playing card-imaging system 200 (for suit and/or rank) mounted below the shuffler 999. Two support posts 601 are shown supporting the shuffler 999. A pair of support posts 601*a* rearmost the delivery shoe assembly 989 rests on a lower support surface 110*g* and a second pair of support posts 601*b* sits within apertures 110*e* in base 100 (FIG. 12). At the playing card insertion area 607, a display panel 609 is provided to display card information, game status information and/or shuffler state information. The imaging system 200 is located beneath a lower surface 602 of the shuffler 999.

The base 508 of the delivery shoe assembly 989 is mounted to the swivel plate 403 and the swivel plate 403 rests on the gaming table surface 900 in a rotatable manner by sliding a housing 210 (FIG. 17) containing the imaging system 200 into a table aperture 405 that extends through a gaming table surface 900. The swivel plate 403 is shown resting on the gaming table surface 900. The flat draw plate 111 extends from the side wall 501 by which playing cards (not shown) pass as they are withdrawn.

The imaging system 200 preferably includes a camera (such as a CMOS camera) 103 is used as the playing card reader and is supported within angled frame support 201. The focal plane of camera 103 is aimed through image window 311 (FIG. 6) which exposes at least part of the face of playing cards (not shown) as they are manually slid across the flat plate 111. Adjustable elements (not shown) are used to adjust the angle of the camera 103. As the shuffler 999 pivots and or otherwise moves horizontally, the entire imaging system 200 and the entire structure beneath the game table surface 900 also moves. In one example of the invention, the movement of the device relative to the table is limited to pivotal movement about axis 901'. In other embodiments, the device is movable freely within an area defined by the size and shape of the table aperture 405 in the table and the X-Y dimensions of the imaging system 200 protective housing 210 (see FIGS. 14 and 17).

Figure 4:
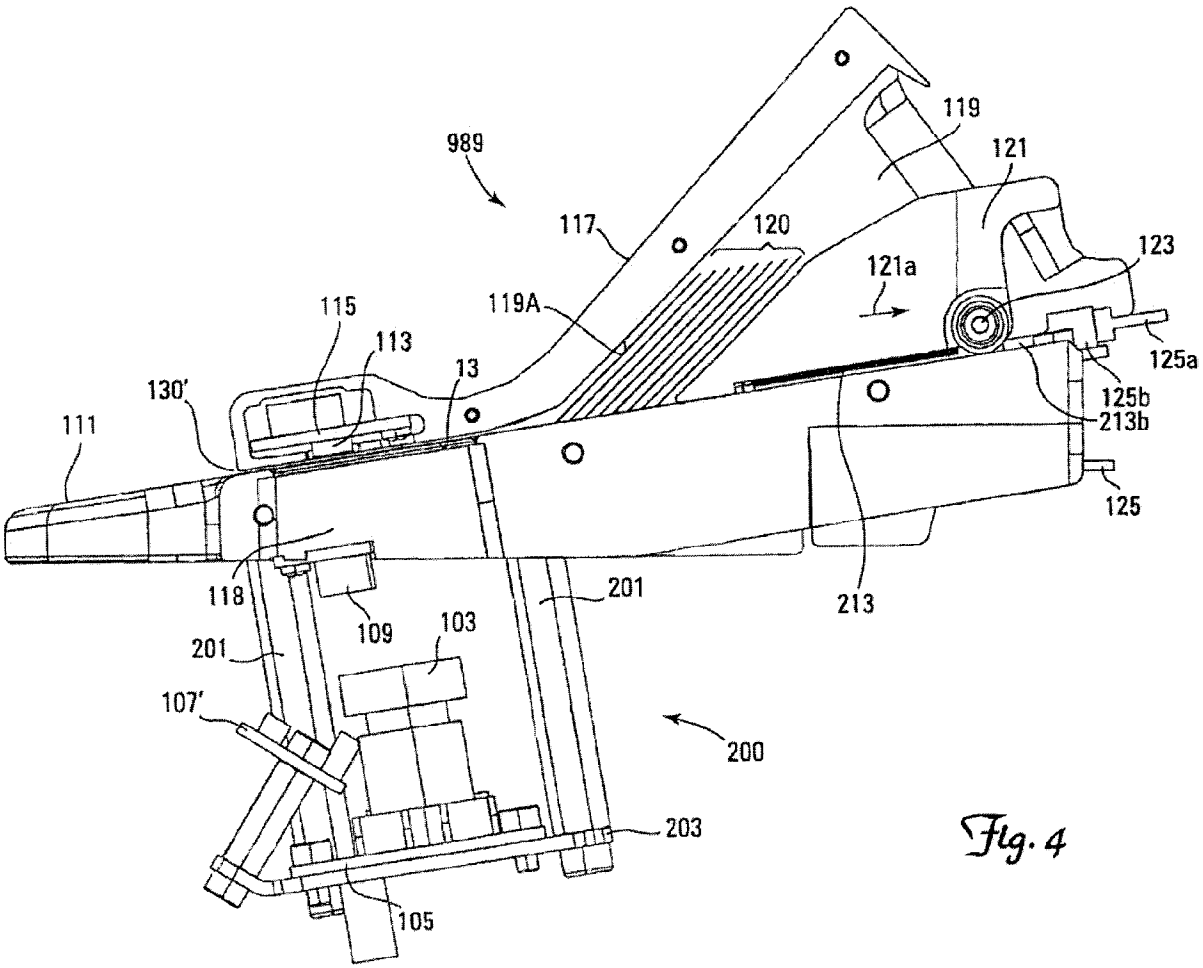
FIG. 4 shows an expanded partial cutaway left-side elevational view of a playing card delivery shoe and playing card reader assembly that may be pivotally mounted on a game table.

FIG. 4 shows a partial expanded left-side elevational view of a card delivery shoe assembly 989 and associated card-imaging system 200 that is removable with respect to the shuffler 999 but is fixed to the base 100. A sliding block or card wedge 121 is shown with a roller 123. The incline may be varied in design so as to vary the pressure placed on cards by the sliding block or card wedge 121. This sliding card wedge 121 presses against the stack of playing cards 120 so that an individual playing card 13 can be manually drawn out over the draw plate 111 past a front face 117 of the delivery shoe assembly 989. Like reference numbers in FIGS. 3 and 4 refer to like elements. A spring 213 may be attached to the base of the sliding block or card wedge 121 to assist in controlling forward and return movement. The spring 213 is elevated above the surface on which the block 121 glides.

Front sloped face 119*a* contacts a leading face of the stack of cards 120 as the cards are pressed forward. A cable/wire connection 125 for transmitting data/signals from the delivery shoe assembly 989 is shown at the rear of the delivery shoe assembly 989. A back direction barrier or stop 213*b* is provided to impede the roller 123 from being too easily removed from the delivery shoe assembly 989. An exit slot or card gap 130' is shown just in front of the draw plate 111, which allows only one playing card 13 at a time to be pulled through the slot 130'.

As a card-receiving area 119 is emptied by the dealer relative to a minimum card capacity of, for example, seven to nine cards, depending on the thickness of a single card, the sliding block or card wedge 121 is in a "fill" position, a wedge magnet(s) 125*a* contacts a magnet sensor board 125*b*. The magnet sensor board 125*b* senses the number of cards in the shoe. When the shoe is empty, the shuffler's processor receives the signal generated by the magnet sensor board 125*b* and subsequently begins dispensing more cards into the card-receiving area 119. This operation relates to a mechanized delivery shoe, in which playing cards are automatically delivered into the delivery end of the delivery shoe. As the playing cards 13 are dispensed from the shuffler 999 (FIG. 3) component into the card-receiving area 119 of the modular delivery shoe assembly 989, the sliding card wedge 121 is pushed back toward the shuffler 999 in direction 121*a*. Once the card-receiving area 119 is completely filled to capacity, the sliding card wedge or block 121 is in a "home" position. At this point, the magnet sensor board 125*b* is in signal transmission, and the shuffler processor instructs the shuffler 999 to stop dispensing cards into the shoe card-receiving area 119. As cards are removed from the dispensing end of the delivery shoe assembly 989 in FIG. 4, and put into play, the sliding card wedge 121 begins to slide toward the dispensing end of the delivery shoe assembly 989 and a sensor board 125*c* goes out of contact with magnets 125*a*.

FIG. 5A is an expanded view of the card delivery shoe assembly's 989 card-imaging system 200, and processing components 110, as shown in FIG. 5B, with support structures removed. A card gap or exit slot 130' is provided between the front face 117 of the delivery shoe assembly 989 and the card-dispensing platform or draw plate 111, wherein the card gap 130' is large enough to receive only one card at a time as it exits the card-receiving area 119. A camera trigger sensor emitter 113 is positioned in the upper housing of the shoe and above the card gap 130'. A camera trigger sensor receiver 109 is positioned on the bottom of the shoe's lower housing 118 and parallel to an image window 311 (see FIG. 6), wherein the image window 311 is, for example, a glass plate positioned and securely fixed in an aperture 312 created in the shoe ground plate 305 (see FIG. 6).

The camera imaging system 200 is positioned below the camera trigger sensor 109 and parallel to the lower surface of the image window 311 (see FIG. 6). The camera imaging system 200 preferably includes at least one two-dimensional CMOS camera 103, an image processing module 105, and an LED light board 107' (FIG. 5A). In a preferred embodiment, the card delivery shoe assembly 989 has a main circuit board 110, as shown in FIG. 5B, with an independent processor. Once a card image is captured and processed by the shoe's imaging system 200, the card information is sent to the main processor 110 of the card delivery shoe assembly 989, and it is this processor 110 that is linked to an external network game computer and/or a processor (not shown). Preferably, there is no communication between the shoe main circuit board 110 and the shuffler main circuit board (not shown). In other embodiments, the shoe circuit board 110 communicates with the shuffler processor (not shown).

The camera trigger sensor emitter 113 preferably emits a constant signal to the camera sensor receiver 109, wherein both sensors are communicating when in an idle state. The camera sensor emitter 113 is provided with a trigger sensor emitter cover plate 115, wherein the trigger sensor emitter cover plate 115 blocks ambient light sources and/or photon noise that can interfere with image acquisition. In a preferred embodiment the imaging system 200 is offset from a centerline of the delivery shoe assembly 989. As shown in FIG. 2, the imaging system 200 (see FIGS. 3, 4, and 5A) lies below an additional section 503*a* of front cover plate 503. This additional portion blocks the camera light source from the view of the user, and additionally blocks ambient light that could interfere with imaging. By offsetting the imaging system 200, a larger sized focal area and a larger cover is obtained, improving the performance of the imaging system 200 over known systems that position the finger insertion slot 505 centrally on the front cover plate 503.

Figure 6:
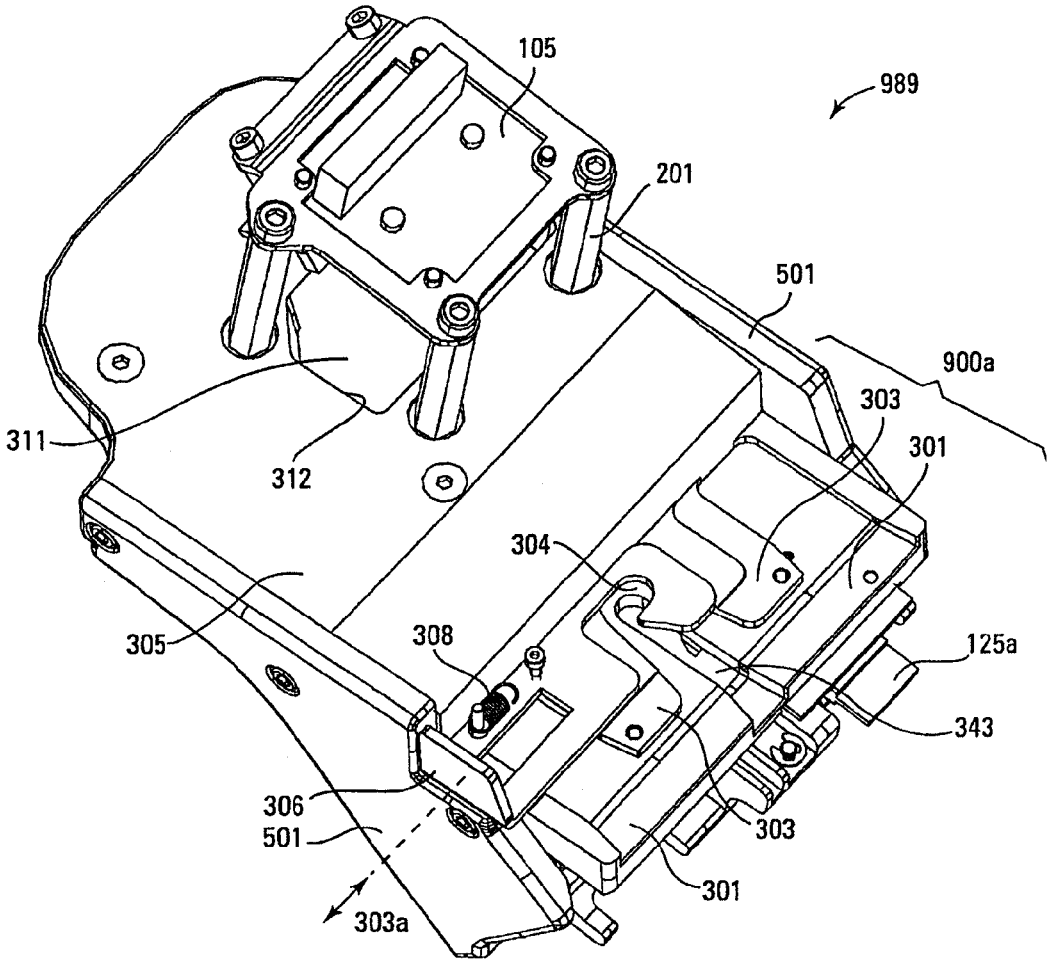
FIG. 6 is a perspective view of a lower surface of the removable card shoe assembly (with mounting base removed).

The LED light board 107' provides a constant available green LED light source that is angled at the image window 311 (see FIG. 6). As a playing card 13 (see FIG. 5A) exits the card-receiving area 119 and enters the imaging area, the trigger sensor emitter 113 light source is blocked by the presence of the playing card 13. In addition, the trigger sensor emitter cover plate 115 ensures the imaging system 200 has a black background necessary for acquiring an accurate card scan. At this point, the sensor emitter 113 is no longer providing a signal to the sensor receiver 109, wherein the presence of the playing card 13 is blocking signal transmission. The lack of a sensor emitter signal activates/notifies the card trigger sensor receiver 109 that a card is present, wherein the sensor receiver 109 sends a signal to the CMOS camera 103. The CMOS camera 103 immediately responds and images the card symbols, wherein the card is positioned face down above the image window with rank and/or suit visible. The lighting board 107' facilitates the image acquisition by providing the CMOS camera 103 with a constant green LED light source that shines through the image window 311 illuminating the symbols/indicia on the playing card 13.

FIG. 6 shows a perspective view of a lower surface of the modular card delivery shoe assembly 989 with its shuffler attachment assembly 900*a* visible at one end of the shoe ground plate 305. In FIG. 6, the lower housing 409', as shown in FIG. 7, has been removed to display the components of the shuffler attachment assembly 900*a* as shown in FIG. 6.

Figure 9:
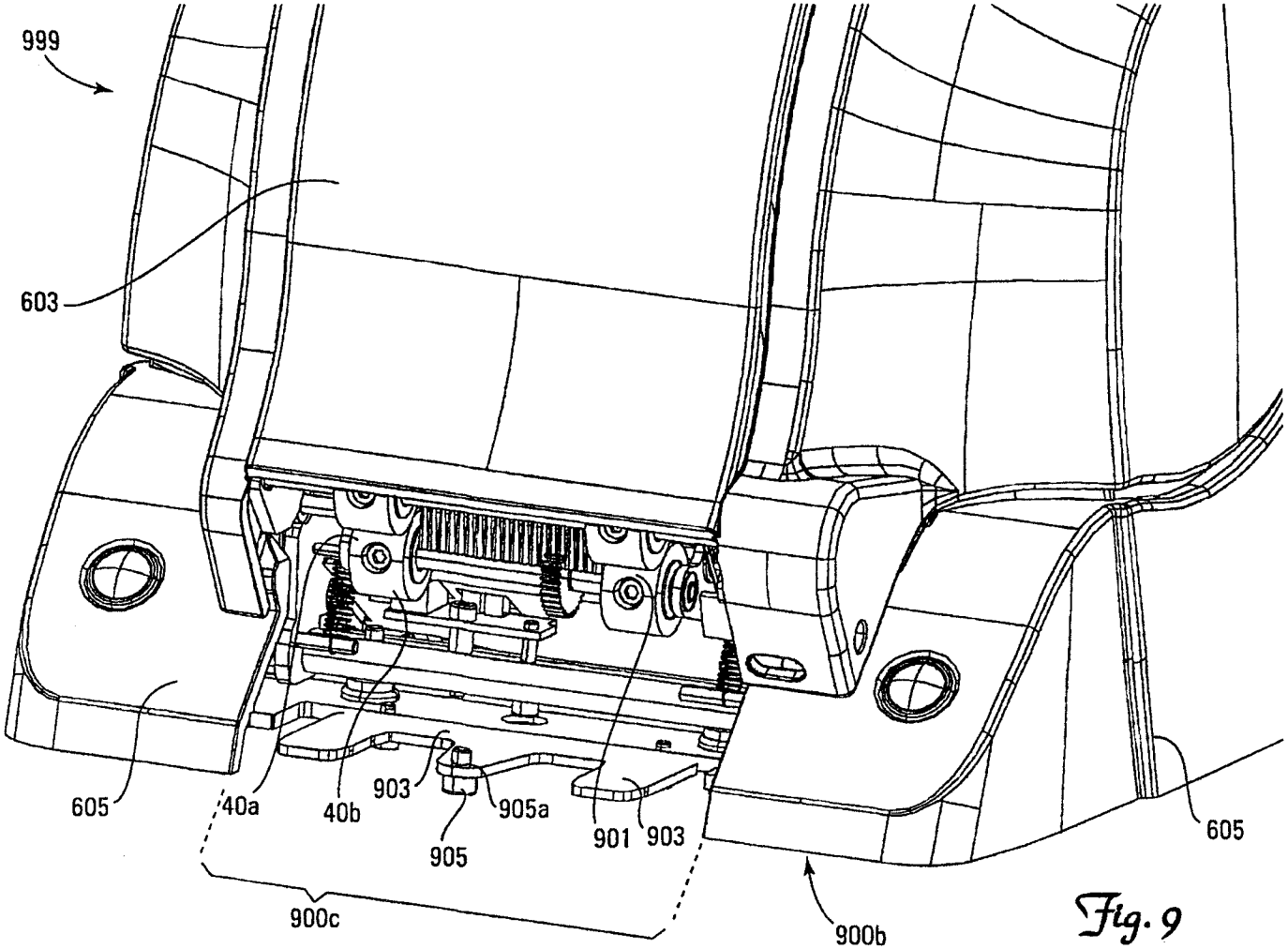
FIG. 9 is a perspective view of the card-dispensing end of the shuffler with the card shoe assembly and base removed.

The shoe ground plate 305 extends to an upper portion of the delivery shoe assembly 989, relative to a card-dispensing end 900*c* of a shuffler 999 (FIG. 9) and includes a ground plate structure 301. The ground plate structure 301 is designed to fit flush against the upper surface of the shuffler's shoe attachment plate 903, as shown in FIG. 9. A locking pin aperture 343 (see FIG. 6) is cut into the ground plate structure 301. A shuffler locking pin 905 (see FIG. 9) fits into the locking pin aperture 343. A locking slider 303 has a slot-shaped aperture 304 that engages locking pin 905. The locking slider 303 moves in the direction of arrow 303*a* and a tongue 306 is recessed within the locking slider 303 is in the locked position. A spring 308 biases the locking slider 303 in the locked position. The locking slider 303 allows for quick release and attachment of the delivery shoe assembly 989 to the shuffler 999 (FIG. 9). Advantageously, no tools are needed to exchange the delivery shoe assembly 989 with a replacement shoe (not shown) in the event of a card-imaging system 200 malfunction, or when it is desired to replace the shoe/card-imaging assembly with another type of front end, such as tray module 43 shown in FIG. 1.

Figure 7:
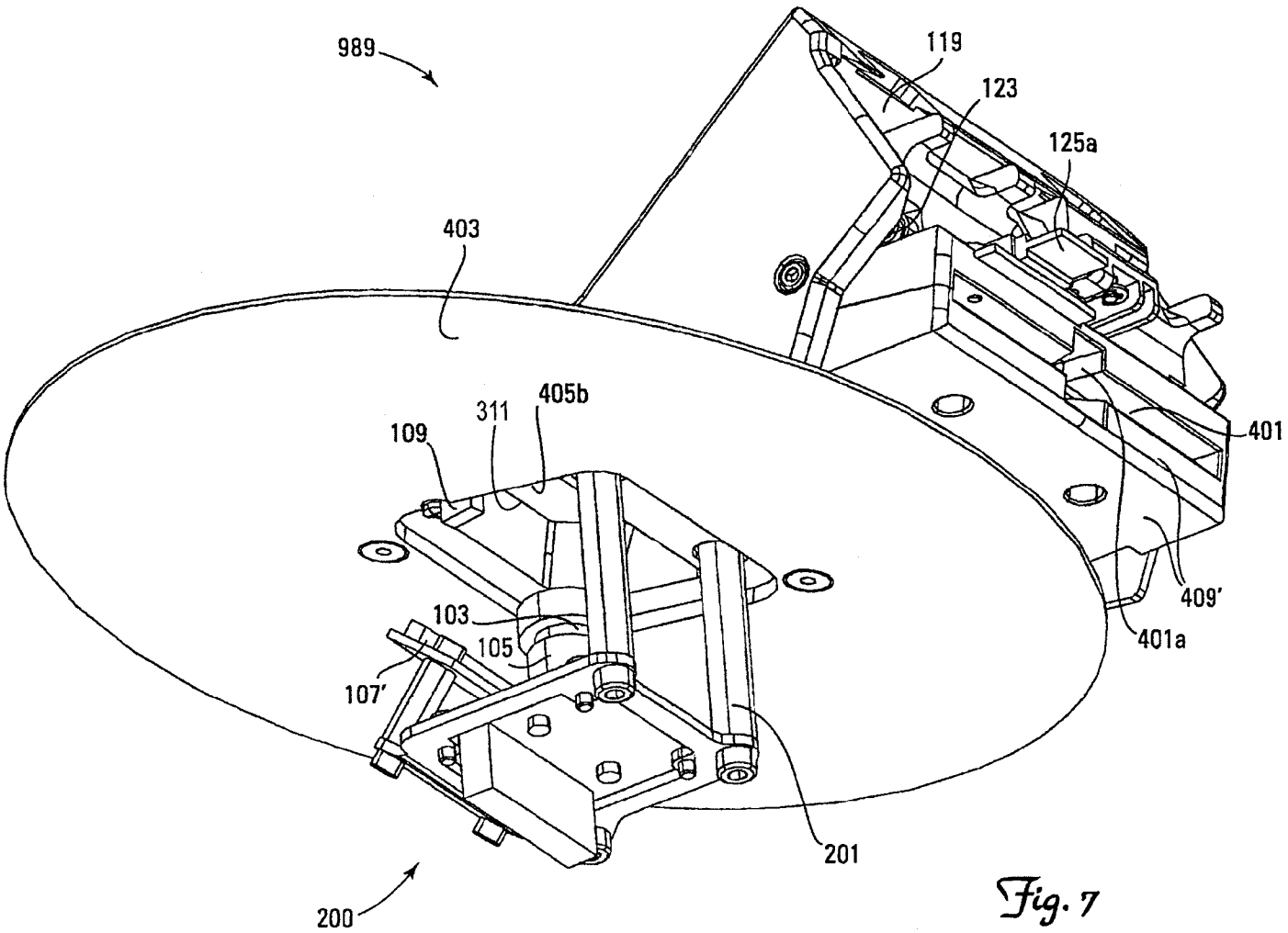
FIG. 7 is a perspective view of the lower surface of the card shoe assembly with mounting base removed.

FIG. 7 is a perspective view of the delivery shoe assembly 989 with swivel mounting plate 403 attached. The view represents a lower side of the delivery shoe assembly 989. In this figure, a shoe housing 409' is installed over the locking components 303, 304, 343 and an aperture 401 is provided with a locking pin-receiving area 401*a*. The shoe cover plate or swivel plate 403 has an aperture 405*b* with dimensions equal to and/or slightly greater than the dimensions of the playing card-imaging system 200 support structure. Preferably, the imaging system 200 is inserted through the cover plate aperture 405*b*, wherein the cover plate or swivel plate 403 rests on the table surface. In other embodiments, the swivel plate 403 is rotationally mounted on a lower base plate (not shown).

Figure 8:
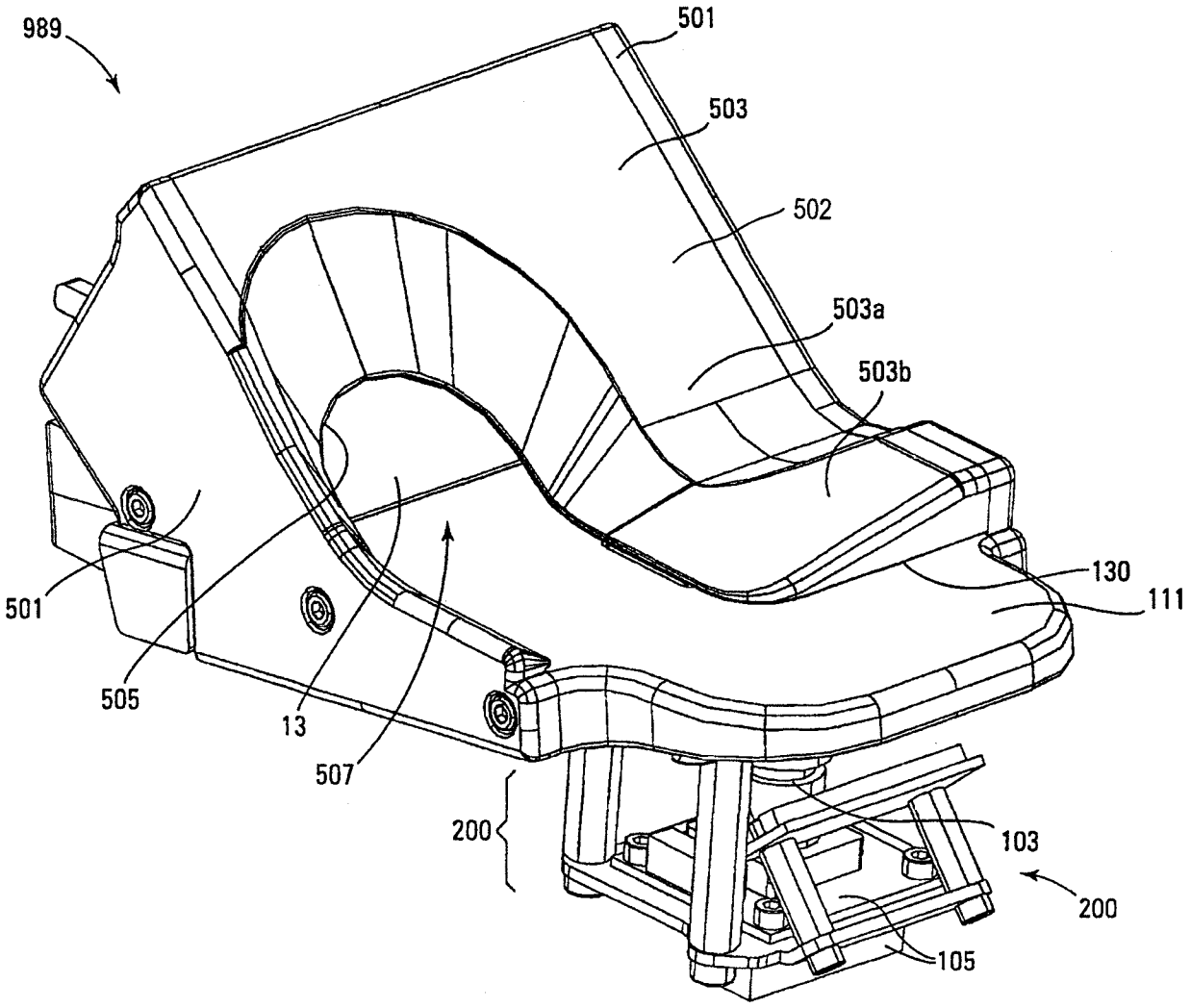
FIG. 8 is a top perspective view of the card shoe assembly with protective housing.

FIG. 8 illustrates the relative positioning of the card-imaging system 200 relative to the front cover plate 503*a* of the card shoe 502. The front cover plate 503 has an additional descending portion 503*a*. Beneath the additional portion 503*a* is housed the camera trigger sensor emitter 113 and the sensor plate 115 (FIG. 5A). The draw plate 111 is located beneath the additional portion 503*a* and surrounds the image window 311 (FIG. 6). The camera trigger sensor receiver 109 (FIG. 5A) is positioned on the lower surface of the flat plate 111 (FIG. 8) and below the image window 311, as viewed in FIG. 7.

The image window 311 according to a preferred form of the invention is offset from a centerline of the shoe. It is advantageous to offset the opening of image window 311 because more space is then provided for the imaging system 200. Since the light source for the imaging system 200 is preferably constant, it is an advantage to provide a larger area 503*b* covering the imaging system 200 so that the light is not seen by a user, and so that ambient light does not interfere with imaging. Otherwise, when a card is not present, the light source would be apparent to a user.

Figure 14:
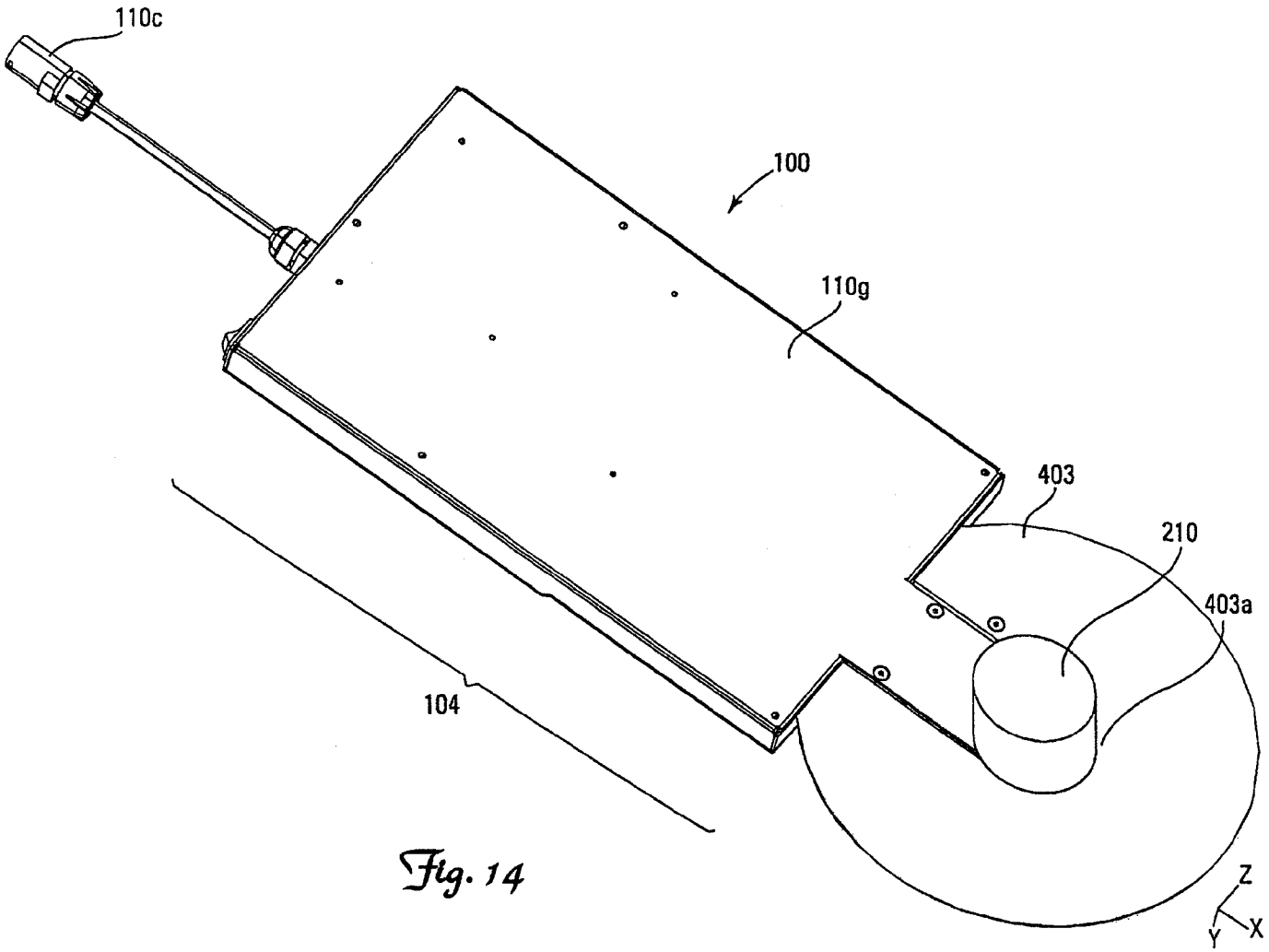
FIG. 14 is a bottom perspective view of the card-reading shoe assembly and base illustrating one example of the exterior imaging system housing.

FIG. 14 provides a bottom view of the card-reading shoe system, wherein the main circuit board base 100 has a lower support surface 110*g* that is substantially flat and an exemplary cylindrical exterior housing 210 of the imaging system 200 are clearly displayed. The swivel plate 403 also has a substantially flat lower surface 403*a*. Referring back to FIG. 8, the card path starts at area 507. A dealer manually applies finger pressure to the playing card 13 at the beveled finger insertion slot 505. As the dealer moves the card outward and over the top surface of the flat draw plate 111, the card passes under the additional portion 503*a* and over the image window 311 (FIG. 7) wherein the camera trigger sensor receiver 109 (FIG. 5A) is activated and the camera imaging system 200 (FIG. 8) captures an image of the playing card 13 as it is removed from the flat plate 111 and put into play. The shutter speed of the camera is fast enough that variations in the rate at which cards are removed does not impact image capture and/or capture image quality. Additionally, angling of the camera toward the focal point through the image window 311 increases the field of vision of the camera and enables greater accuracy in the reading of information from the faces of the cards.

FIG. 9 shows a dispensing end 900*c* of the shuffler 999 with the detachable delivery shoe 989/base assembly 100 detached. The shuffler 999 has an upper surface with a rear side of shuffler 605 and a top cover 603. At the lower end of the top cover 603, the nip rollers 40*a* and 40*b*, are exposed. A card nip line 901 is shown between the nip rollers 40*a* and 40*b*, wherein the card nip line 901 allows only a formed group of one or more randomized cards to exit the shuffler 999. Although a preferred shuffler 999 has compartments configured to form groups of cards, the shuffler 999 is programmable to insert only one card into a compartment so that only one card is dispensed. The delivery shoe assembly 989 is fixedly mounted to base 100 (see FIG. 12). The shoe attachment assembly 900*b* includes a shoe attachment plate 903 with a locking pin 905 secured into an aperture 905*a* located on the attachment plate 903.

Figure 10:
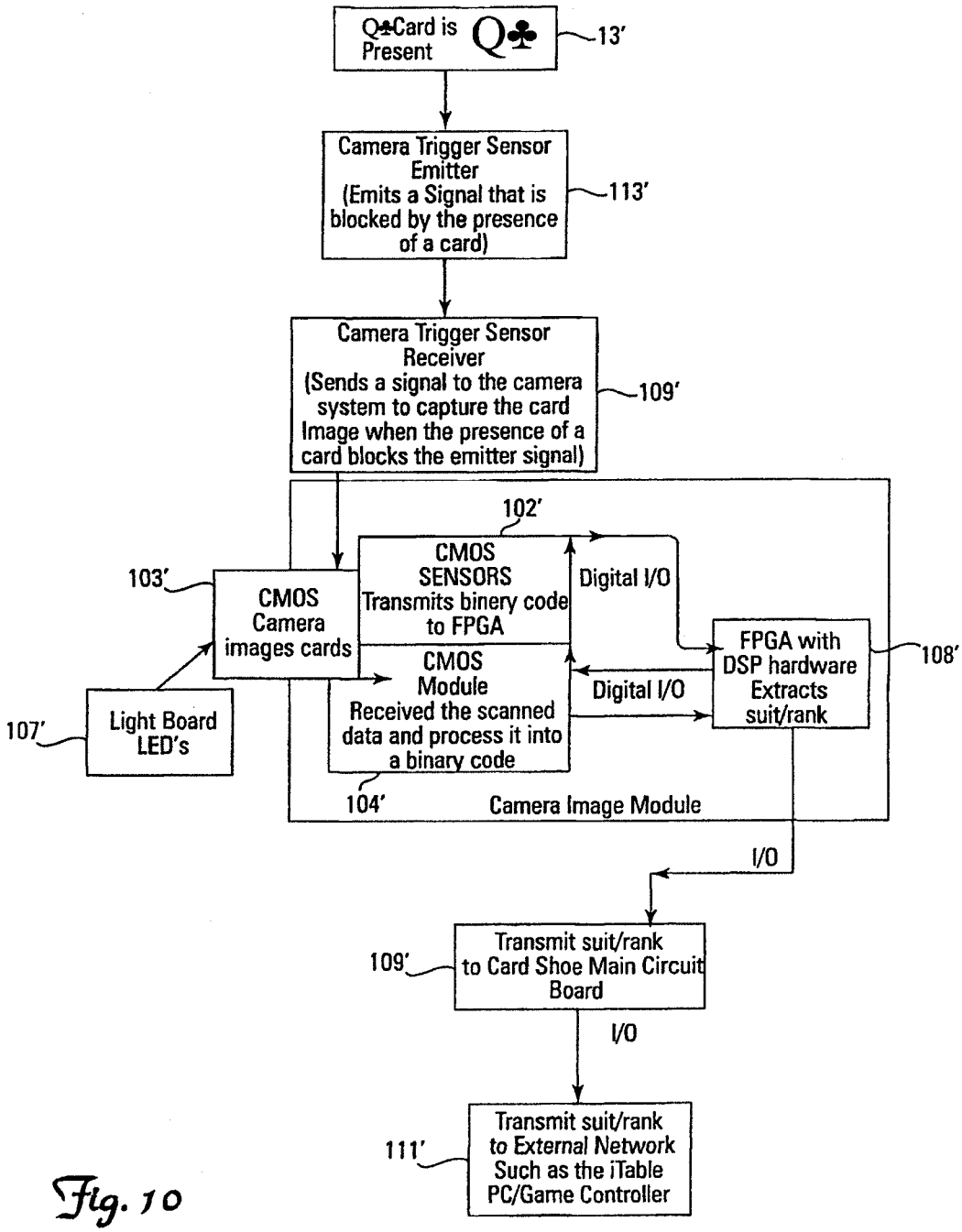
FIG. 10 is a schematic diagram of the functions of a card-reading module.

A schematic flow diagram of the camera imaging system process and associated data transfer is provided in FIG. 10. The process includes a step 13' of positioning a card in the imaging area. A camera trigger sensor senses 113' the presence of the card. When the card is present, this signal is blocked. A camera sensor receiver senses the blocked state 109', triggering the operation of the imaging system. According to the process, a CMOS camera images the card 103'. The CMOS module processes the captured data and converts the data to binary code. This binary code is transmitted 102' to an FPGA with DSP hardware to extract card rank, suit or rank and suit in step 108'.

Once the scanned image is acquired 103' by the CMOS camera, as shown in FIG. 10, the CMOS (complementary-metal oxide semiconductor) module reduces the black and white card data to a series of gray scale values 104', wherein the gray scale values are then assigned a binary code. This binary code is transmitted 108' to at least one FPGA/DSP (Field Programmable Gate Arrays/Digital Signal Processors) hardware component, wherein the FPGA/DSP hardware component has associated memory with stored binary codes relative to each of at least one card rank and a suit. The FPGA/DSP hardware correlates the new binary code with stored binary codes and determines the rank and suit of the card. Once the rank and suit determination has been completed by the FPGA/DSP hardware component(s), it is the FPGA/DSP that transmits 109' the rank and suit information to the shoe main circuit board 110. The card information is then transmitted 111' to an external computer or onto an external network. Preferably, the shoe main circuit board 110 (see FIGS. 5A and 13) is linked to an operatively associated PC and/or external network, via I/O ports 110*c*, such as, but not limited to, a table PC/game controller with programmed game rules relative to the game in play, wherein the PC/game controller determines a game outcome based upon the card data transmitted from the shoe main circuit board 110.

FIG. 12 shows the base assembly 100. The assembly includes a first upper surface 110*a* that defines an upper main circuit board housing, and a second upper surface 110*g*. Apertures 110*e* accept the rear opposing support posts 601 of the shuffler 999 (FIG. 3). The front support posts 601 of the shuffler 999 rest on the second upper surface 110*g* when the shuffler 999 is mounted to the base 100. The delivery shoe assembly 989 also defines a portion of the plate assembly (see FIG. 14). In a preferred form of the invention, delivery shoe assembly 989 is fixedly attached to a rectangular portion 104 by means of screws, bolts or other known fasteners. In another embodiment, the shoe assembly (not shown) is removably attached to the flat portion 104 of the base 100 by means of a quick connect/disconnect fastener.

Figure 13:
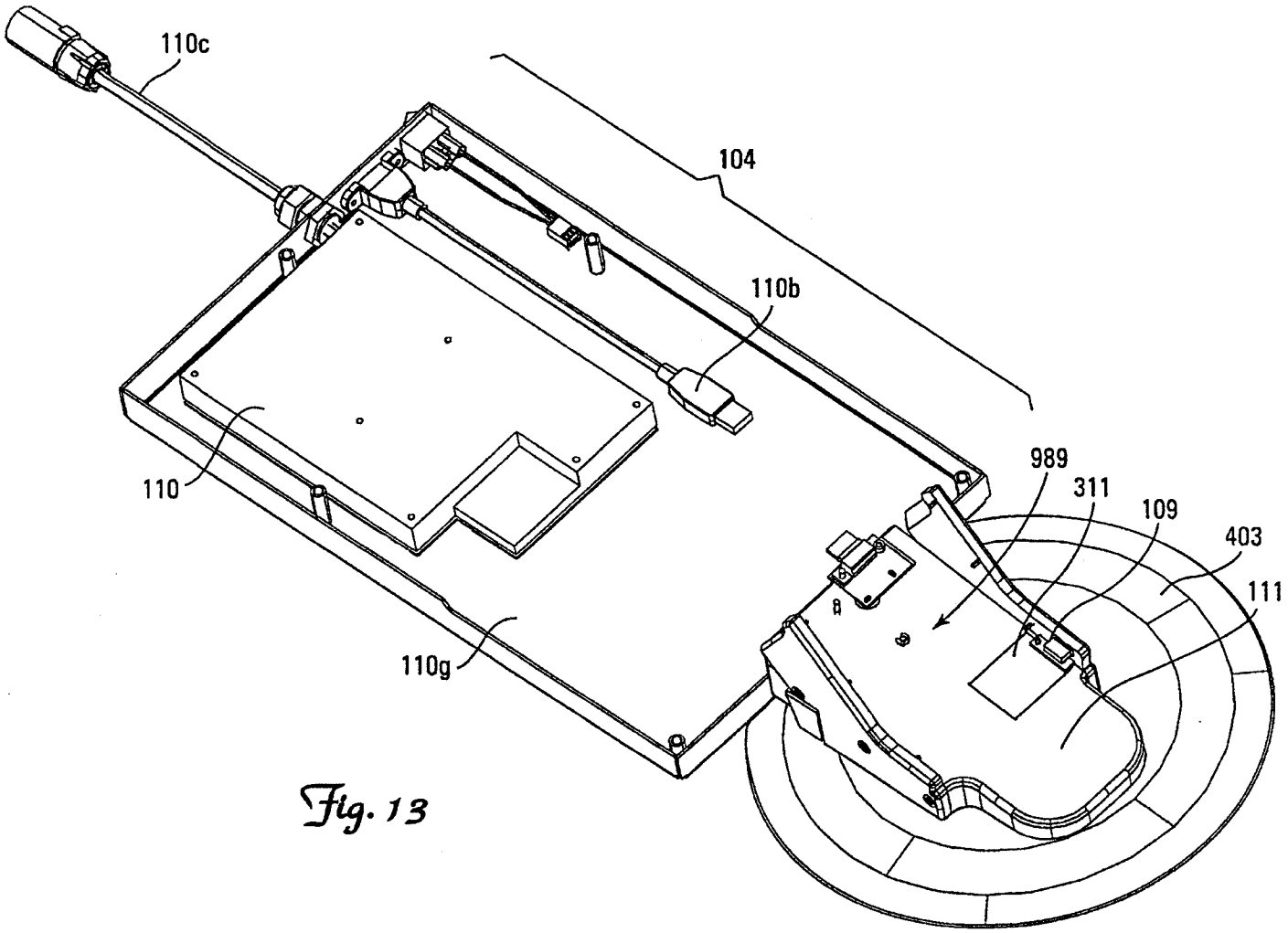
FIG. 13 is a top perspective view of the card-reading shoe assembly and base supporting the shoe main circuit board with upper protective housing structure removed.

FIG. 14 shows this same base assembly 100 from below. The assembly includes the mounted swivel plate 403, wherein the swivel plate 403 is fixedly attached to the flat portion 104 via screws. FIG. 13 shows the same structure from above with the main circuit board housing removed, revealing shoe main circuit board 110 and I/O ports 110*b* and 110*c*. An I/O connection 110*c* allows the shuffler 999 (see FIG. 3) to communicate with an external computer and/or network. Internal I/O port 110*b* in one embodiment is a USB port. The USB port may be used to connect the shoe processor with a removable display/user interface.

Figure 15:
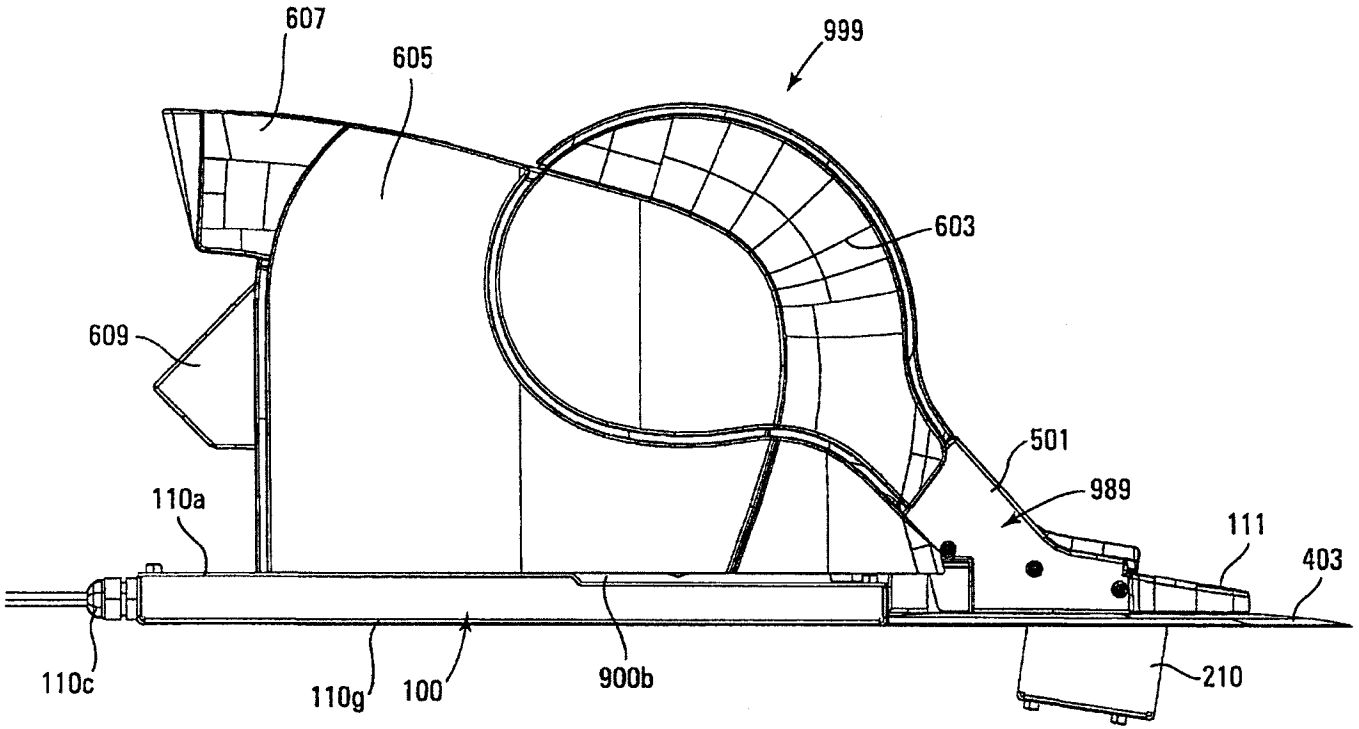
FIG. 15 is a side elevational view of an exemplary shuffler/shoe system mounted to a base with affixed exterior housings.

This interface/display can be used to train the card-reading system to recognize different cards. For example, a library of card data, one data set corresponding to each brand of cards may be input into the shoe main circuit board 110 so that the card-imaging system is capable of accurately reading each brand of card in the library. In alternative embodiments, I/O port 110*b* allows the shuffler processor 110 to communicate with the shoe processor (not shown). After the library of card values is input, the input/display device may be disconnected from I/O port 110*b*. The main circuit board housing is replaced (FIG. 12) and the shuffler 999 may then be mounted on the base 100, as shown in FIG. 15.

The card delivery shoe assembly 989 is removably attached to the dispensing end of the shuffler 999 (FIGS. 9 and 15) by lining up the shoe locking pin aperture 343 (FIG. 6) with the shuffler locking pin 905 (FIG. 9) and manually sliding the shoe toward the shuffler 999. Once the shuffler locking pin 905 is pushed along the entire length of the shoe locking pin aperture 343, the shuffler locking pin 905 travels into the shoe locking slider 303 (FIG. 6). The shoe locking slider 303 secures the shoe to the shuffler locking pin 905 with the shoe ground plate structure 301 (FIG. 6) resting level on the upper surface of the shuffler's shoe attachment plate 903 (FIG. 9).

Figure 17:
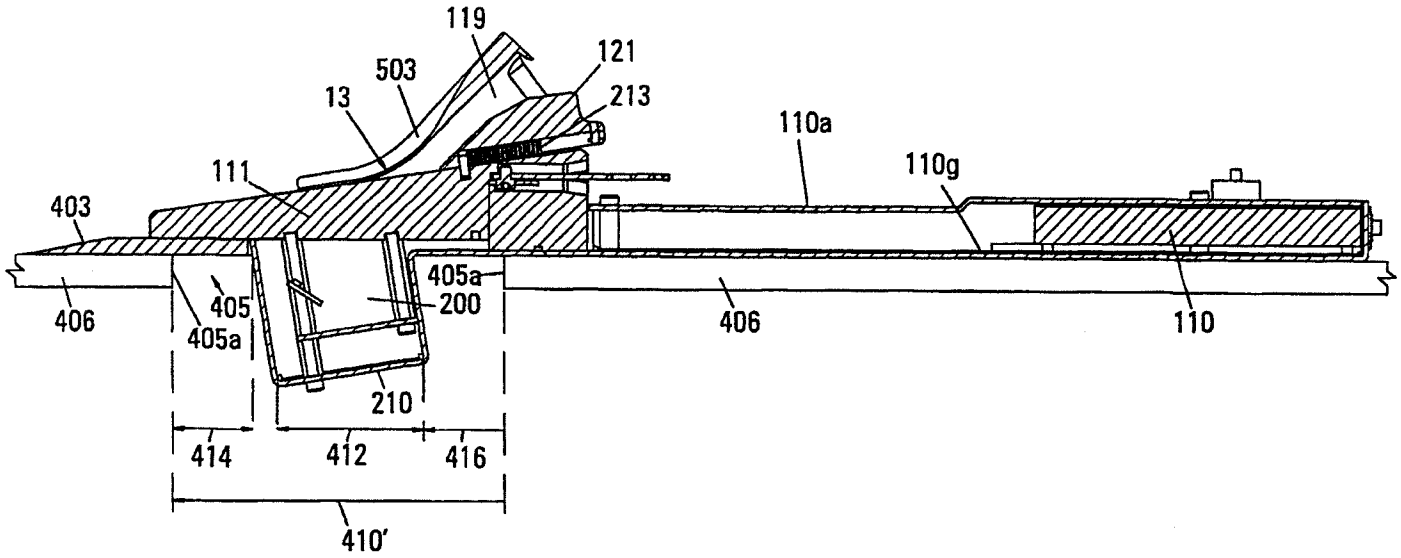
FIG. 17 is a cross-sectional view of the base/shoe assembly shown in FIG. 12, taken along line A-A.

A cross-sectional view of the structure shown in FIG. 12 taken along lines A-A is shown in FIG. 17. The imaging system 200 in one embodiment is protected by an external housing 210. The external housing 210 is preferably cylindrical and completely encloses the imaging system 200 to prevent damage and tampering.

The inner edges 405*a* of table top 406 and table aperture 405 are shown. This table aperture 405 in one embodiment is circular and of a diameter 410' that is much larger than a diameter 412 of exterior housing 210. The entire structure is capable of movement relative to this table aperture 405. The shuffler 999 (FIG. 15) is capable of rotational motion, linear motion arcuate motion and combinations thereof. As shown in FIG. 17, the shuffler 999 (FIG. 15) can be moved a distance 414 or a distance 416 within the boundaries of table aperture 405. The base plate 403 is of a size and shape such that the table aperture 405 is completely covered and out of the view of the players, regardless of the position of the shuffler relative to the table. In a preferred embodiment, the base plate 403 is circular or oblong in shape.

Shufflers of the present invention advantageously maintain a low profile and at the same time are adjustable on the table top to suit the size, and preferences of the dealer.

Figure 18:
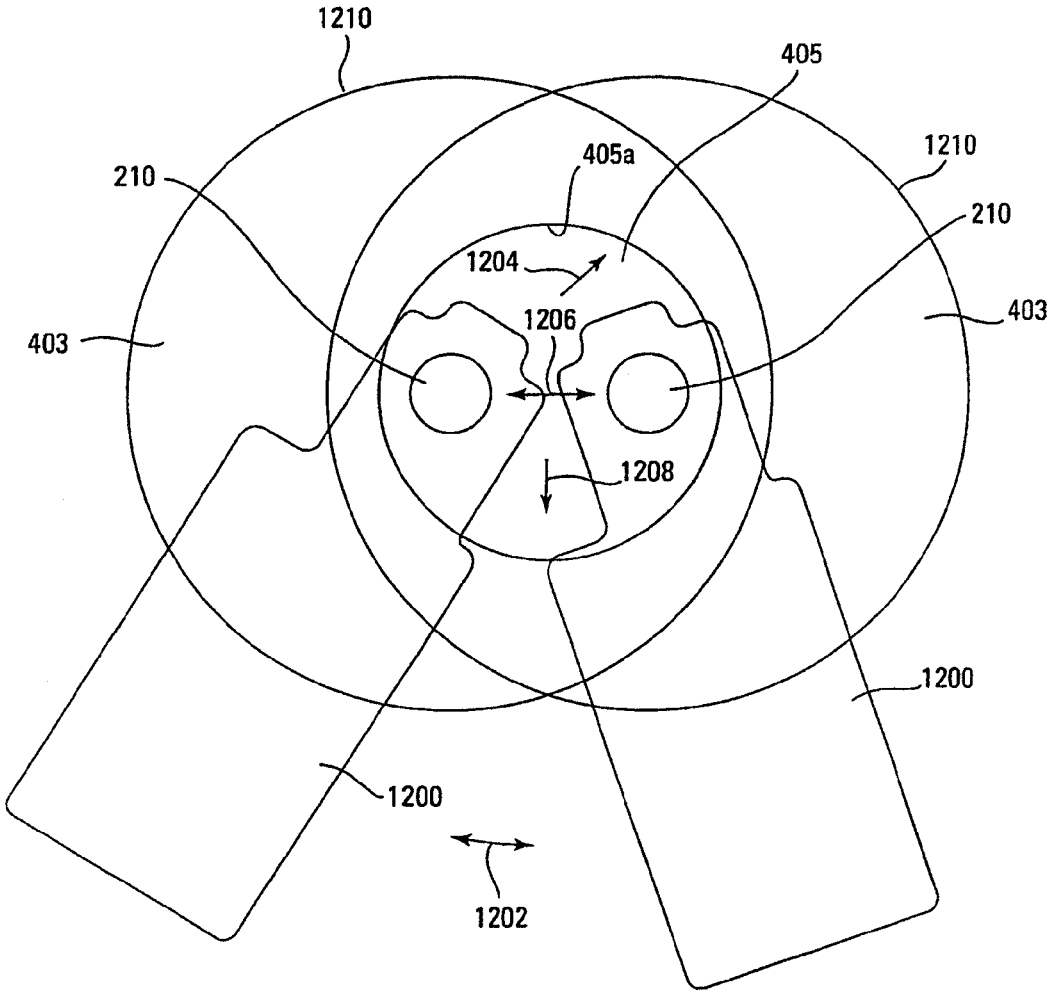
FIG. 18 is a schematic top plan view of an exemplary shuffler/shoe/base assembly mounted in a table aperture, illustrating range of motion of the shuffler with respect to the table.

In FIG. 18, the table aperture 405 is shown as circular in shape. The inner edges 405*a* define a range of motion of the shuffler 999 (FIG. 15) with integrated delivery shoe assembly 989 (FIG. 15), hereinafter a swivel mounted shuffler 1200.

The range of motion of the shuffler 1200 is limited by the size and shape of a horizontal cross-section of the external housing 210. In this example, the housing 210 is tubular with an enclosed lower surface. The shuffler 1200 may be pivoted, for example, in an angular direction 1202, or may be moved linearly, for example, in directions 1204, 1206, 1208, while the exterior edges 1210 of mounting plate 403 (FIG. 17) cover stationary table aperture 405.

By providing a range of motion sufficient to compensate for the various sizes and preferences of dealers, the shuffler 1200 can be positioned on a table in a manner that optimizes dealer comfort, preventing repetitive motion injuries.

Dealers may wish to alter the position of the shuffler 1200 relative to the table at various intervals within a shift to relieve muscle stress and increase comfort.

A preferred structure includes a table with an aperture of a size sufficient to allow a maximum linear travel in any given direction to be about 8 inches, or more preferably about 6 inches. The motion may be linear, arcuate, angular, may have an X and Y component, and may be a combination thereof.

Since the position of the protective cover 210 is fixed relative to the swivel plate 403, the table aperture 405 remains concealed, unless the shuffler 1200 (FIG. 18) is removed completely from the table.

The importance of the overall height of the shuffler is significant from an ergonomic standpoint. Shufflers that provide a card insertion area at one end of the machine and a card output area at the opposite end must be low profile enough relative to the gaming surface to allow the dealer to reach over its upper surface on a repetitive basis. Lower profile shufflers are preferable because the lifting motion is reduced. By installing a card-imaging system 200 (FIG. 17) below the table top, the height of the shuffler is not significantly increased. This structure allows for the addition of card recognition to an existing shuffler "engine 999" of modular design, while maintaining a desirable low profile, and while incorporating features that enable ergonomic positioning on the table.

Preferably, the dimensions of the table aperture 405 provide the imaging system 200 (FIG. 5) (which is preferably fixed with respect to the body of the shuffler 999 or delivery shoe assembly 989) with a significant degree of unrestricted movement within the aperture 405, wherein the imaging system 200 can be repositioned within the aperture 405 easily and safely. The exterior protective cover 210 provides ample protection for the imaging system 200. The combined shuffler 999/delivery shoe assembly 989/base 100 movement over the gaming table surface and the imaging system 200 range of motion within the table aperture 405 allows a dealer to maneuver and/or reposition a shuffler/shoe angle and or position on a gaming table surface relative to dealing a card game, wherein repositioning the shuffler/shoe provides a higher degree of comfort and ease when dealing a card game.

Figure 16:
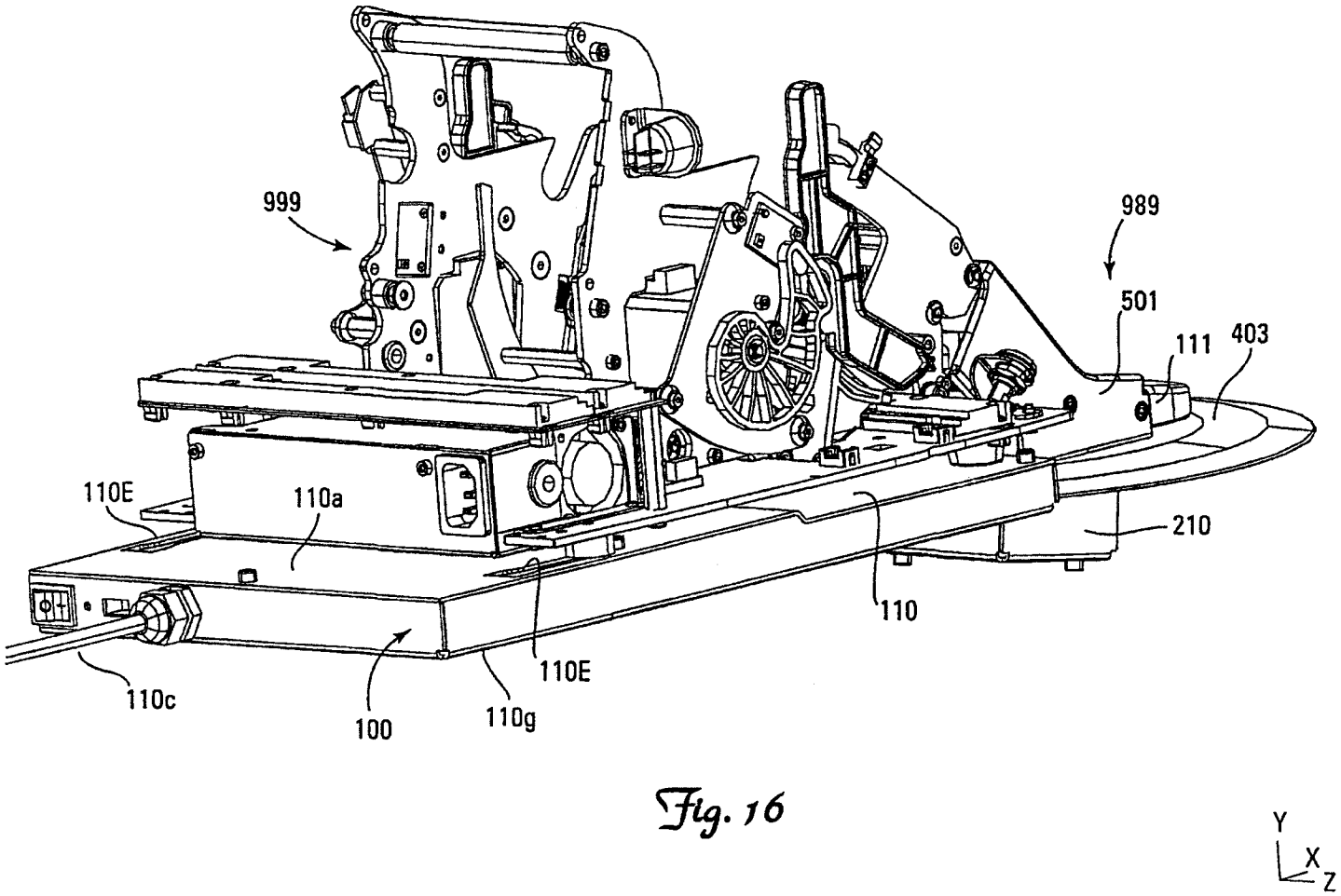
FIG. 16 is a rear perspective view of the shuffler/shoe assembly with shuffler exterior housing and carousel removed.

FIG. 16 shows a rear perspective view of the shuffler/shoe assembly with the cover and carousel removed. A delivery shoe main circuit board 110 (see FIG. 13) is positioned below surface 110*a*. It is preferred that the rear upper plate/housing 110*a* of the main circuit board has two apertures 110*e* (FIG. 12), wherein the shuffler support posts 601*a* and 601*b* (FIG. 3) fit securely into the apertures 110*e*. The upper housing plate 110*g* closest to the delivery shoe is preferably lower than surface 110*a*. The vertical drop of the front upper housing plate 110*g* is approximately equal to the depth of aperture(s) 110*e* (FIG. 12). This configuration provides a stable and level support structure for shuffler 999 while attached to the base 100.

FIG. 15 shows a side elevational view of the shuffler 999 attached to the delivery shoe assembly 989 and its base 100, wherein the shuffler 999 appears level and stable mounted to the base. Preferably, the shuffler structure 999 is manually adjusted with respect to the table by physically rotating the shuffler structure horizontally clockwise and/or counterclockwise, wherein the shuffler structure's available range of motion is relative to the shuffler's immediate position on the table and/or the dimensions of the table aperture 405 formed by the distance between ends of the aperture 405 (FIG. 17).

In one embodiment, the shoe main circuit board 110 (FIG. 13) has programmed game rules, wherein the shoe main circuit board 110 determines a game outcome based on the card rank and/or suit information transmitted by the FPGA/DSP hardware component(s) of the card-imaging system 200. Therefore, it is the shoe main circuit board 110 that transmits a game outcome (based on dealt card information) via I/O port 110*c*, (FIG. 13) to an operatively associated PC and/or external network. In other embodiments, game rules reside in an external game computer that communicates with the delivery shoe assembly 989 via port 110*c*. The two-dimensional CMOS card data acquisition and associated FPGA processing is prior art and is disclosed and fully described in the related U.S. patent application Ser. No. 11/484,011, filed Jul. 7, 2006, now U.S. Pat. No. 7,933,448, issued Apr. 26, 2011. As with all references cited herein, this patent is incorporated herein by reference in its entirety.

Figure 11:
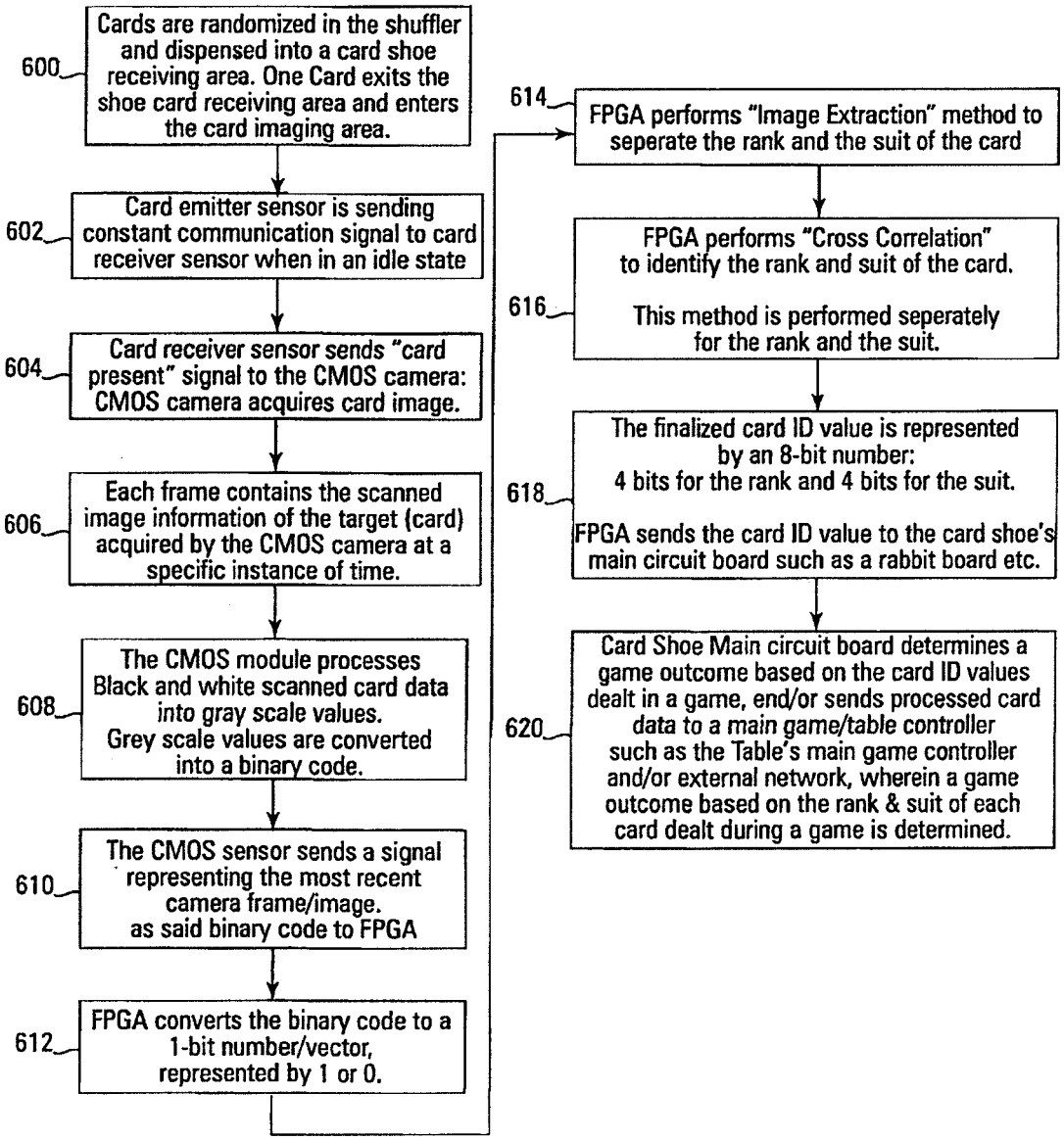
FIG. 11 is a flow diagram representing the card-imaging process.

FIG. 11 is a process flow diagram describing the process of imaging cards as they are randomized and move through the shoe.

In step 600, randomized groups of cards are pushed out of a compartment in the carousel 2' and into area 119 of the delivery shoe assembly 989. The sliding wedge 121 retracts to permit cards to move into a staging area. Prior to a first card being moved past sensing system 200, the card emitter sensor sends a signal 602 to the receiver that no card is present in the sensing position (playing card 13 shown in FIG. 17).

When a single card is manually moved into a sensing position, the card receiver senses the presence of a card 604. Within the imaging area, data is captured 606 representative of a frame of image information. This information is acquired by the CMOS camera at time t.

Next, the CMOS module converts 608 the scanned card data into gray scale values. The gray scale data is sent to the FPGA 610 where it is converted into binary code 612.

An FPGA next performs image extraction 614 to differentiate between the rank and suit images. A cross-correlation 616 is performed to identify rank and suit. Rank and suit is determined separately.

The card rank and/or suit is determined and represented by an 8-bit number. The FPGA sends this data 618 to its associated processor or to an external game controller. The final step 620 is to determine game outcome using the card information and programmed game rules.

Although specific examples and specific materials and dimensions may be stated in descriptions to better enable practice of the present technology, those descriptions are intended to be non-limiting specifics enabling generic concepts in the practice of the invention. One skilled in the art would fully appreciate and being enabled from the present disclosure to use alternatives, substitutes and equivalents in the construction of the described technology, without creating a separate and distinct invention.

What is claimed:

1. An automatic card shuffler, comprising:
a card infeed area;
a card shuffling mechanism;
a card unloader;
a detachable shoe removably coupled to the card shuffler and comprising a card imaging system configured to read a rank and a suit of each card as each card is removed from the detachable shoe, wherein the card unloader is configured to transfer shuffled cards from the card shuffling mechanism to the detachable shoe, and wherein the detachable shoe is configured such that each card is individually removable from the detachable shoe; and
an alignment structure for aligning the detachable shoe and the card shuffling mechanism when the shoe is attached to the card shuffling mechanism.

2. The automatic card shuffler of claim 1, wherein the card shuffling mechanism is configured to continuously shuffle cards returned to the card infeed area.

3. The automatic card shuffler of claim 1, wherein the card shuffling mechanism comprises a plurality of adjacent card-receiving compartments.

4. The automatic card shuffler of claim 3, further comprising a carousel structure including the card-receiving compartments.

5. The automatic card shuffler of claim 3, further comprising a leaf spring retainer in each card-receiving compartment.

6. The automatic card shuffler of claim 1, further comprising a processor that controls an operation of the shuffler.

7. The automatic card shuffler of claim 6, wherein the processor converts signals received from the card imaging system to rank and suit data.

8. The automatic card shuffler of claim 6, wherein the detachable shoe is connected to the card shuffling mechanism by a quick disconnect coupling.

9. The automatic card shuffler of claim 1, wherein the detachable shoe further comprises a card receiving area configured to receive a stack of cards before being dispensed from the detachable shoe.

10. The automatic card shuffler of claim 9, wherein the detachable shoe further comprises a sliding card wedge disposed in the card receiving area, the sliding card wedge configured to press against the stack of cards in the card receiving area such that an individual card of the stack of cards can be manually drawn out of the detachable shoe.

11. An automatic card shuffler, comprising:
a card shuffling mechanism comprising:
a card infeed area configured to supply a plurality of cards to the card shuffling mechanism; and
a card unloader configured to remove the plurality of cards from the card shuffling mechanism; and
a detachable shoe removably coupled to the card shuffling mechanism and comprising a card imaging system configured to detect at least one indicia of each card of the plurality of cards, wherein the card unloader is configured to transfer the plurality of cards from the card shuffling mechanism directly into the detachable shoe.

12. The automatic card shuffler of claim 11, wherein the detachable shoe is configured to supply the plurality of cards from the detachable shoe one card at a time.

13. The automatic card shuffler of claim 11, wherein the detachable shoe further comprises a card receiving area configured to receive the plurality of cards before the plurality of cards is dispensed from the detachable shoe.

14. The automatic card shuffler of claim 13, wherein the detachable shoe further comprises a sliding card wedge disposed in the card receiving area, the sliding card wedge configured to press against a stack of the plurality of cards in the card receiving area such that an individual card of the plurality of cards can be manually drawn out of the detachable shoe.

15. The automatic card shuffler of claim 14, wherein the sliding card wedge is biased toward a card output area of the detachable shoe.

16. The automatic card shuffler of claim 11, wherein at least a portion of the card imaging system of the detachable shoe is positioned to overlie each card of the plurality of the cards as each card is removed from the detachable shoe.

17. The automatic card shuffler of claim 11, wherein the detachable shoe further comprises a card output area having an opening for removal of cards that is offset from a center of a card path at the card output area of the detachable shoe in a direction transverse to an intended direction of travel of a card along the card path.

18. The automatic card shuffler of claim 17, wherein the detachable shoe comprises an upper plate forming the opening for removal of cards, wherein the upper plate is larger on a first lateral side of the opening than on a second lateral side of the opening, and wherein the card imaging system is positioned beneath the upper plate proximate the first lateral side of the opening.

19. The automatic card shuffler of claim 11, wherein the card shuffling mechanism is configured to continuously shuffle any cards of the plurality of cards returned to the card infeed area.

20. The automatic card shuffler of claim 11, wherein the detachable shoe is connected to the card shuffling mechanism by a quick disconnect coupling.

* * * * *